US009718521B2

(12) United States Patent
Derrah

(10) Patent No.: US 9,718,521 B2
(45) Date of Patent: Aug. 1, 2017

(54) DRIVE-N-GLIDE SURFBOARD (JET DRIVE)

(71) Applicant: Steven John Derrah, Portsmouth, RI (US)

(72) Inventor: Steven John Derrah, Portsmouth, RI (US)

( * ) Notice: Subject to any disclaimer, the term of this patent is extended or adjusted under 35 U.S.C. 154(b) by 0 days.

(21) Appl. No.: 13/677,153

(22) Filed: Nov. 14, 2012

(65) Prior Publication Data

US 2014/0134900 A1 May 15, 2014

(51) Int. Cl.

| | |
|---|---|
| ***B63H 11/02*** | (2006.01) |
| ***B63B 35/79*** | (2006.01) |
| ***B63H 11/01*** | (2006.01) |
| ***B63H 11/04*** | (2006.01) |
| *B63C 9/00* | (2006.01) |
| *B63H 11/00* | (2006.01) |

(52) U.S. Cl.

CPC ..... *B63B 35/7943* (2013.01); *B63H 11/01* (2013.01); *B63H 11/04* (2013.01); *B63C 9/0011* (2013.01); *B63C 2009/0017* (2013.01); *B63H 2011/008* (2013.01)

(58) Field of Classification Search

CPC ..... B63B 35/7943; B63B 35/79

USPC ..... 440/38–47; 60/221

See application file for complete search history.

(56) References Cited

U.S. PATENT DOCUMENTS

| | | | | |
|---|---|---|---|---|
| 5,199,913 | A * | 4/1993 | Toyohara et al. | 440/47 |
| 6,872,105 | B2 * | 3/2005 | Dusablon et al. | 440/1 |
| 7,993,178 | B2 * | 8/2011 | Railey | 441/74 |
| 2011/0201238 | A1 * | 8/2011 | Rott et al. | 440/6 |

* cited by examiner

*Primary Examiner* — Edwin Swinehart

(57) ABSTRACT

This new art offers an improvement to conventional surfboards as well as any previous motorized jet surfboards. This application includes an electric powered surfboard equipped with high volume jet drive units that power it forward and significantly improve a surfer's wave fielding and catching ability. Once a wave is caught the drive unit can be shut off by the surfer. Then instantly, two flush fitting glide doors close the jet tube intake openings allowing the surfboard's bottom to return to a planning surface with no protrusions, except for fins, and no water filled jet tubes left open to detract from the surfboard's critical gliding ability when surfing waves. Also, there's a crowned deck shape that allows thin rail sensitivity for turning performance and a motor battery arrangement that provides mass centralization of weight. All this, combined with several wireless control means define this new fine handling motorized surfboard.

1 Claim, 18 Drawing Sheets

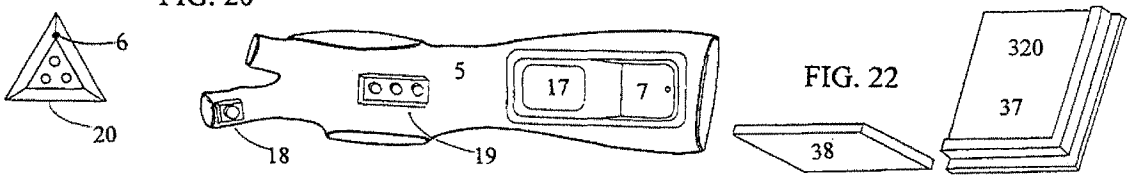
FIG. 20
FIG. 22
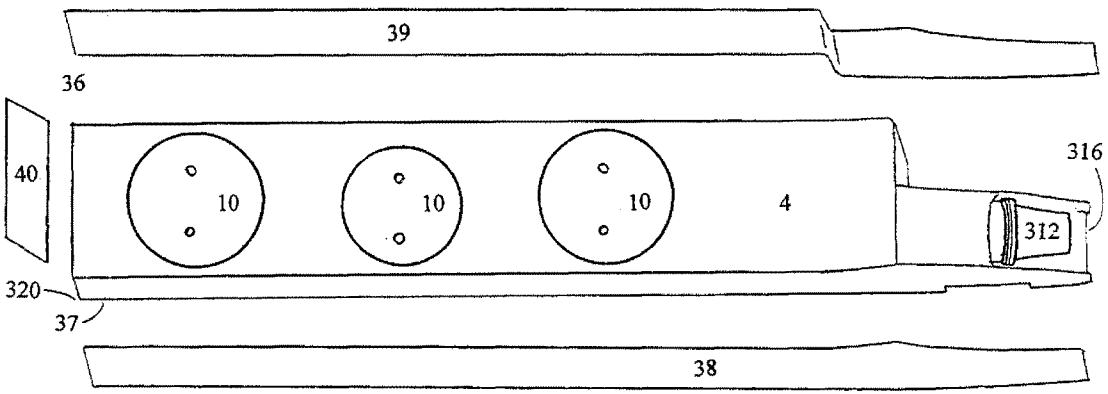
FIG. 21
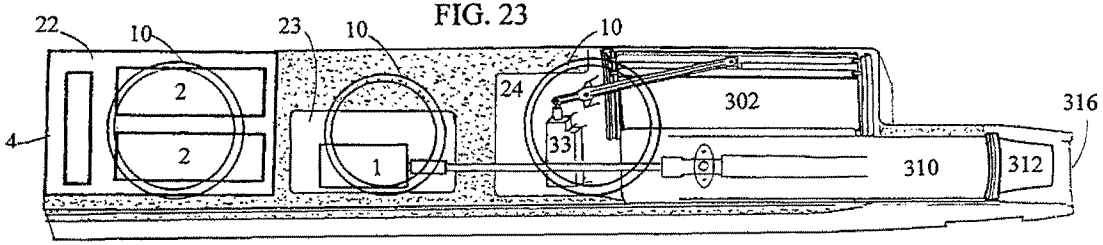
FIG. 23

DRIVE-N-GLIDE SURFBOARD (JET DRIVE)

BACKGROUND OF THE INVENTION

1. Field of the Invention

The present invention relates to electric powered surfboards.

2. Description of the Related Art

Electric powered surfboards for the purpose of providing paddling assistance have come on to the market in recent years that claim to be able to maintain traditional surfing performance. These are jet drives that surf waves with the power on which is not traditional surfing. If these jet drive boards were to surf waves with the power off the large jet tube intakes on the bottom surface of the surfboard will significantly restrict forward movement and thwart turning performance of any surfboard, especially short ones. These intake holes allow water to flow through them even when the power is off. Therefore this disruption of the planning hull makes the claim of "traditional surfing performance" impossible.

The present invention is different because it provides a way to shut off the motors and close the jet openings. The present invention is better because of the flush fitting glide doors that allow a motorized surfboard to glide like a traditional non-powered surfboard when riding a wave, with no disruption of the planning surface. Other considerations like the crowned deck shapes that can allow thin rail sensitivity on a surfboard that is 5" thick or more at the prone and standing area.

And the mass centralization of onboard weight that makes the surfboard respond like a much lighter surfboard when in motion.

Also, the motor battery drive cases that are stringer bondable and customizable to accommodate any surfboard's shape.

And finally, the several control means outlined in this patent application round out the list of improvements over all previous motorized surfboard designs.

The present invention solves a few problems with the open holed jet boards and adds some new advantages over these boards and all existing related prior art. The prior art referred to is Rott et al US2011/0201238A1 and Railey #1 US2011/0056423A1 and Railey #2 U.S. Pat. No. 7,731, 555B2.

SUMMARY OF THE INVENTION

With this water jet propelled surfboard with flush fitting doors surfers turn a historic corner to experience a new reality in modern surfing. Enabling not only prone paddling assistance, but also making it possible for a surfer to travel fast while standing up on a short board that would otherwise sink without a wave pushing it along. While standing, the surfer's overall height gives him increased visibility and the advantage to see sets of oncoming waves. Another advantage is the ability to quickly maneuver to a more desirable point of entry while standing, and power drive into a wave that is outside the pack of surfers sitting in the conventional take off area.

Once the rider feels the wave is carrying him forward it is time to push the power off button. This starts the sequence to stop the impeller and close the glide doors in sequential order.

Now that the board is gliding along motor off, like a conventional planning hull surfboard, the rider is able to drop in and surf the wave at will, doing all the moves an average surfer would normally perform on a short, high performance surfboard.

This water jet propelled surfboard can weigh up to two and a half times the weight of a conventional surfboard due to the motor, batteries and moving parts. These components are strategically placed between the surfer's front and rear foot and just aft of the widest point of the surfboard thereby centralizing the weight mass at the surfboard's balance point and contributing to the good handling characteristics.

The present invention formula to combine centralization of weight mass with the thin rails provided by the crowned deck and the flush fitting glide doors, make the water jet propelled surfboard the finest handling motorized surfboard ever developed, and the only one that really surfs. It is designed to surf waves with the motor and impellers off and the glide doors shut with no protruding parts or open cavities to interrupt the flow of water across the hull's planning surface.

BRIEF DESCRIPTION OF DRAWINGS

FIG. 20 is a top view of one embodiment of the control glove with control buttons and radio transmitter and the receiver wafer with battery level lights.

FIG. 21 is an angled top view of one embodiment of a preassembled starboard motor battery drive case with uncut sides and ends shown next to their respective placements FIG. 22 is a sample cut view of the motor battery case's molded base and easy to bond sidewall.

FIG. 23 is an angled see through top view of one embodiment of a preassembled starboard MBD case showing interior components as well as the access cover placements of the jet drive case in reference to FIG. 21.

DETAILED DRAWING DESCRIPTIONS

Figure 1:
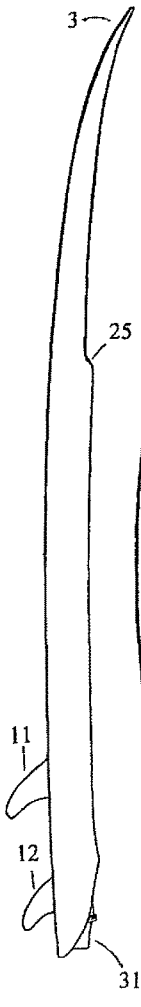
FIG. 1 is a side view of one embodiment of a jet drive surfboard showing the crowned deck shape built into the surfboard's body and the jet nozzle is seen at the tail.

FIG. 1 shows a side view of one embodiment of a single stringer, twin foam and fiberglass epoxy short surfboard 3 that has twin jet drives with intake doors 301, 302. This side view shows one of the jet nozzles 312 at the tail end of the surfboard 3. Also shown is the tail fin 12 and one of the side fins 11. The side profile of the crowned deck 25 is seen raised over an otherwise common short surfboard profile. This embodiment of the crowned deck 25 has a kick tail shape at the rear end of the board 3 to provide rear foot traction, but is optional on this jet drive motorized surfboard. A traction pad could be mounted on a flat tail shape to achieve the same effect.

Figure 2:
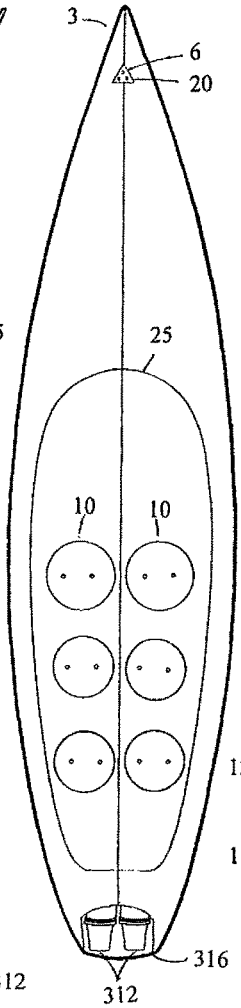
FIG. 2 is a top view of one embodiment of a jet drive surfboard showing the crowned deck perimeter as well as the six deck assess covers and the antenna/battery gauge wafer at the nose plus the twin jet nozzles at the tail.

FIG. 2 shows a top view of the single stringer, twin foam, fiberglass epoxy short surfboard 3 that contains twin jet drives with intake doors 301, 302. The crowned deck outer perimeter can be seen providing a level yet heightened deck surface. On this deck surface are six access covers 10, four small and two large. These covers are waterproof and strong enough to withstand a surfer's full weight stomping on them. They also should fit perfectly flush with the deck surface when screwed all the way down to contact the o-ring waterproofing gaskets that are attached to the threaded cover frames. All six cover frames would preferably be installed or molded into the motor battery drive case 4 deck 36. They should also be as low profile as possible so they don't take up too much interior cabin space. The access covers have two small diameter holes in each to provide a way to un-screw them with a special pronged handle. The special handle and small holes are necessary to prevent the surfer's feet from stubbing toes or tripping. The combination battery light 20 and receiving antenna 6 are seen at the surfboard's 3 nose. A preferred construction would be a thin profile, triangle shaped, flush fitting water proofed wafer that houses the LED lights that indicate battery charge levels as well as the receiver's antenna end.

Figure 3:
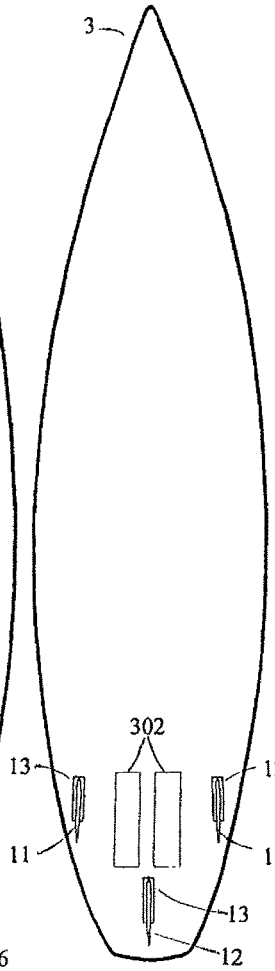
FIG. 3 is a bottom view of one embodiment of a jet drive surfboard showing the three fins and the outline edges of the jet glide doors in the shut position.

FIG. 3 shows a bottom view of the modern short surfboard 3 version of the present invention jet surfboard showing two side fins 11 and one tail fin 12 with low profile square fin boxes 13 holding them upright and allowing an interchangeable feature. Also, shown are the outline edges of the jet intake doors 302 in the shut position. These flush fitting, opening and closing intake doors 302 make it possible to surf waves like a conventional surfer with no protrusions or intrusions on the bottom surface to interrupt water flow and thwart wave handling.

Figure 4:
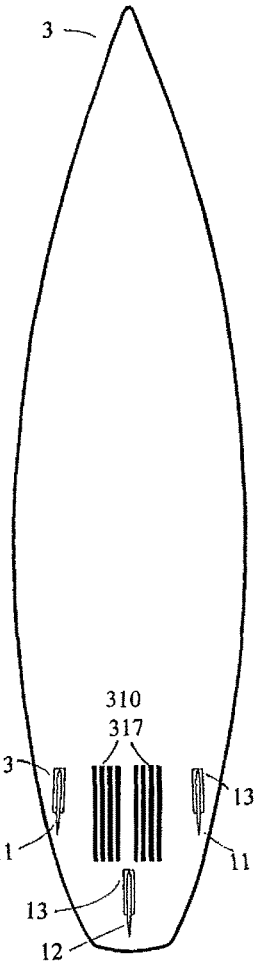
FIG. 4 is a bottom view of one embodiment of a jet drive surfboard showing the three fins and the glide doors open, revealing the large intake openings and the debris grids.

FIG. 4 shows another bottom view of the short surfboard 3 version of the present invention jet surfboard with the intake doors 302 open, showing the two large vacuum based tube housings 310 with the debris grids 317 in place. These grids 317 prevent large chunks of matter from being sucked into the jet tubes 310 that could cause damage to the impellers 313 and other in-tube components.

Figure 5:
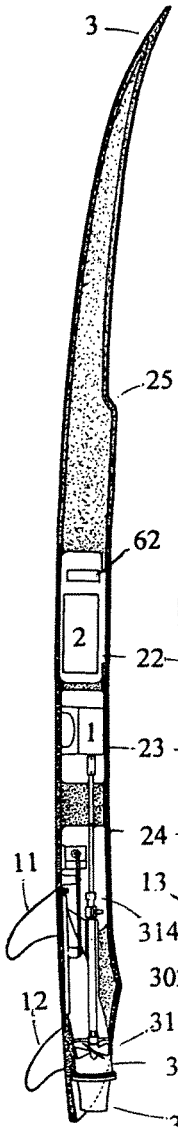
FIG. 5 is a cutaway side view of one embodiment of a jet drive surfboard revealing an inside look at the three separate cabins (motor, battery, and drive) contained in one MBD case within the surfboard's body.

FIG. 5 shows a cutaway side view of the single stringer, twin foam and fiberglass epoxy short surfboard 3 with twin jet drives 301 and intake doors 302. This view reveals a dry battery cabin 22 with two replacement battery packs 2 and one control box 62 inside it. Next to it is another dry cabin 23 housing the motor 1 in its stationary motor mount 321. The cabin 23 can remain dry because of the shaft O-ring 322 on the dividing wall. Aft of this is the drive cabin 24 which is a semi dry cabin with a cover 10 that provides access to the outside of the jet tube housing 310 as well as all of the glide door's 302 working components 33, 306, 35 and the shaft tube's grease nipple 324 and sealed bearing 314. Inside the jet tube housing 302 the impeller 313 is seen near the detachable jet nozzle. All these components and their functional merits are explained in FIG. 18 which is a larger cutaway side view of this intake door 302 equipped jet drive 301 surfboard.

Figure 6:
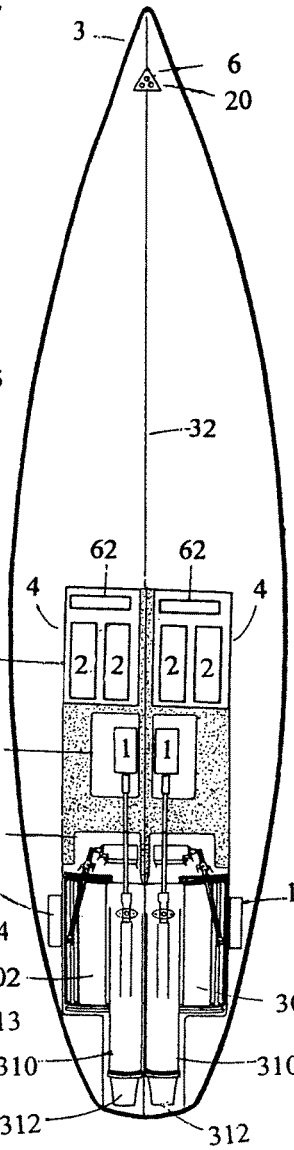
FIG. 6 is a see through top view of one embodiment of a jet drive surfboard revealing an inside look at all the components contained in the two MBD cases and how they fit into the parameters of a modern short surfboard.

FIG. 6 shows a cutaway top view of the twin jet short surfboard 3 revealing all the working components within the two motor 1 battery 2 drive 310 cases 4 are glued to the wood stringer 32. This top view shows how the two MBD cases 4 fit within the parameters of a modern short surfboard 3. The two side fin boxes 13 are seen outside the MBD cases 4. The triangle shaped combination battery light 20 and receiving antenna 6 are seen at the nose of the surfboard 3. A closer view of the working MBD cases is provided in FIG. 19.

Figure 7:
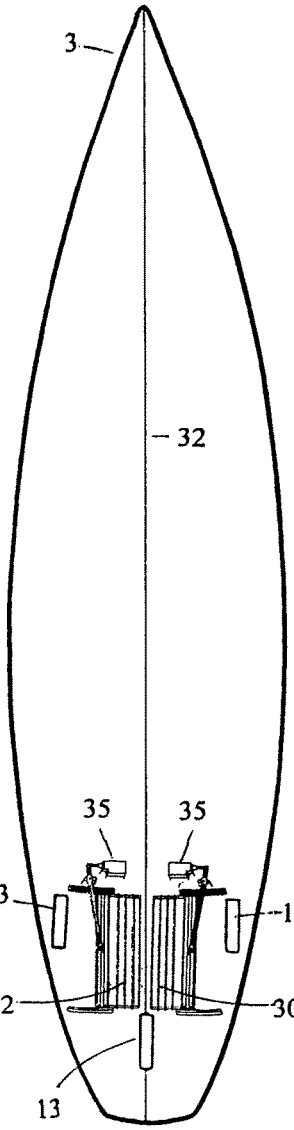
FIG. 7 is a see through top view of one embodiment of a jet drive surfboard revealing an unobstructed look at the two glide doors in the shut position nestled between the three fins.

FIG. 7 is a cutaway top view of the present invention's intake door mechanism 302 with the jet tube housings 310 removed. This shows the two intake doors 302 in the shut positions. By way of the door arm 305 powered by the quick action linear actuator 35. The two rectangular doors 302 fit nicely between the two side and one aft fin boxes 13.

Figure 8:
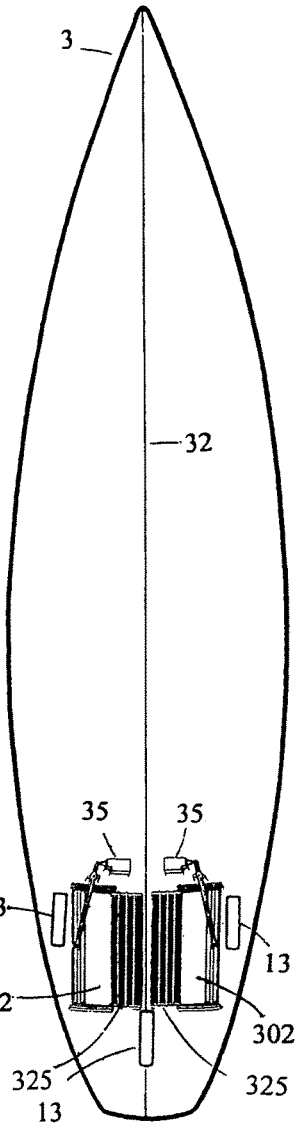
FIG. 8 is a see through top view of one embodiment of a jet drive surfboard revealing an unobstructed view of the two glide doors in the open position nestled between the three fins.

FIG. 8 is a cutaway top view of the present inventions intake door mechanism 302 with the jet tube housings 310 removed. This shows the two intake doors 302 in the open positions by way of the intake door arm 305 powered by the quick action linear actuators 35. The jet housing openings 325 are designed to be wide enough to vacuum up large quantities of water.

Figure 9:
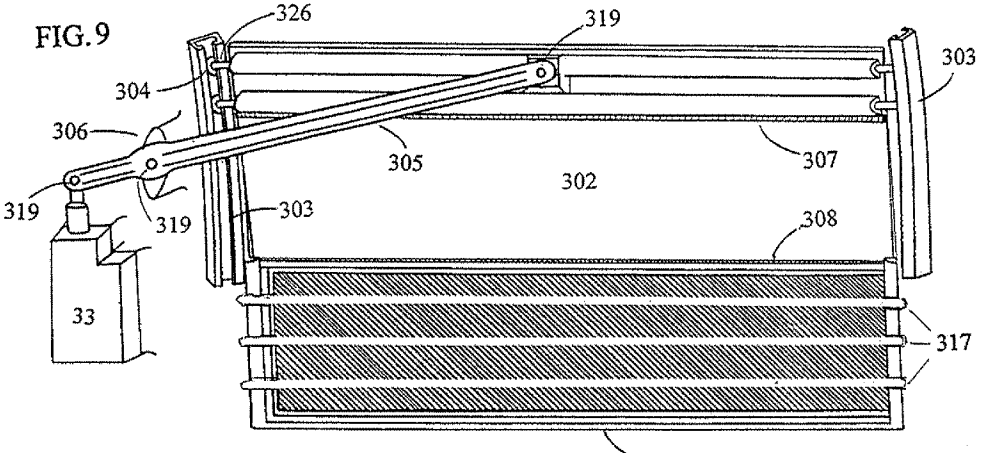
FIG. 9 is a close up top view of one embodiment of one jet drive glide door in the open position with the jet tube housing removed showing all the components necessary to open and close the precision fitting door.

FIG. 9 shows a close up top view of one embodiment of a jet drive 301 intake door 302 mechanism with the jet tube housing 310 removed. The large precision framed opening 325 is seen with its tiny stair step shaped edges. These tiny stair steps allow at least one tier to hook up to the equal but opposite stair step shaped intake door that fits into it. These fine shapes provide a trough-like ramp with creases that help guide and seat the intake doors 302 into place. These shapes are molded into the bottom of the case base 37 and work in conjunction with the intake door tracks 303 and wheels 304. The short throw linear actuator 33 is seen retracted, therefore opening the intake door 302 via the door arm 305 that pivots off the door arbor 306 fastened by the connector pin 319. The debris grid bars 317 are shown hovering above the step framed opening 325.

Figure 10:
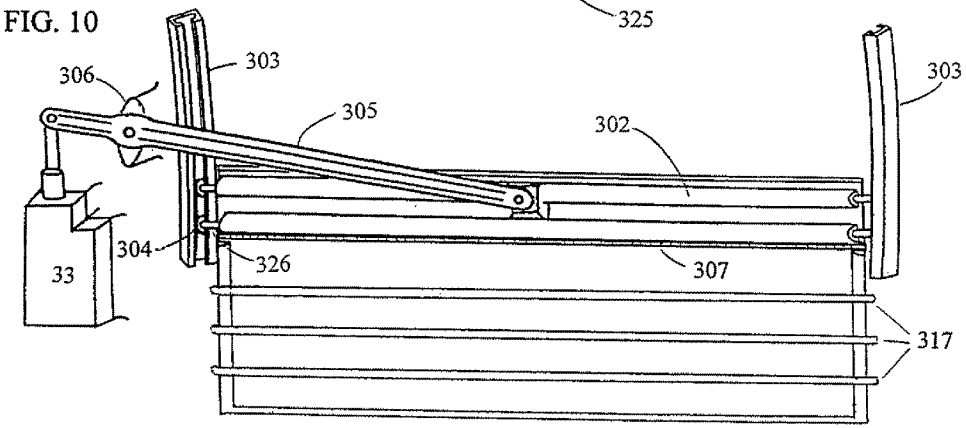
FIG. 10 is a close up top view of one embodiment of one jet drive glide door in the closed position with the jet tube housing removed showing all the components necessary to open and close the precision fitting door.

FIG. 10 shows a close up top view of the jet drive intake door 302 mechanism with the jet tube housing 310 removed. The waterproof actuator 33 is seen extended therefore pushing the door arm 305 that is pinned 319 to the top of the pivot arbor 306 in the opposite direction to close the jet intake door 302. The intake doors 302 are preferably made out of a durable rigid plastic. They are rectangular in shape and have two longitudinal pipe shaped humps that add rigidity to the arm connection area and are attached to the door axles 326 that the track wheels 304 are mounted to. The track wheels 304 are locked into the glide door tracks 303 that have a "C" shaped channel the length of the track 303 allowing the wheels 304 to roll back and forth with very little resistance. The tracks 304 are slightly curved end to end to allow the glide doors 302 to travel slightly downhill onto the trough like ramp 318 that leads to the tiny stair stepped frame opening 325 that seats into the shut position shown in this FIG. 10. The debris grid bars 317 are seen hovering over the closed intake door 302 allowing the intake door 302 to operate freely, yet still trap chunks of debris from entering the jet tube housing 310. Another feature that is unique to the jet intake doors are the open, the closed, and the travel sealing gaskets 307, 308, 309 and 327. The outer pressure gasket 307 is shown in FIG. 10. The sealing of the intake doors is important for proper suction plus keeping the drive cabin from filling with water.

Figure 11:
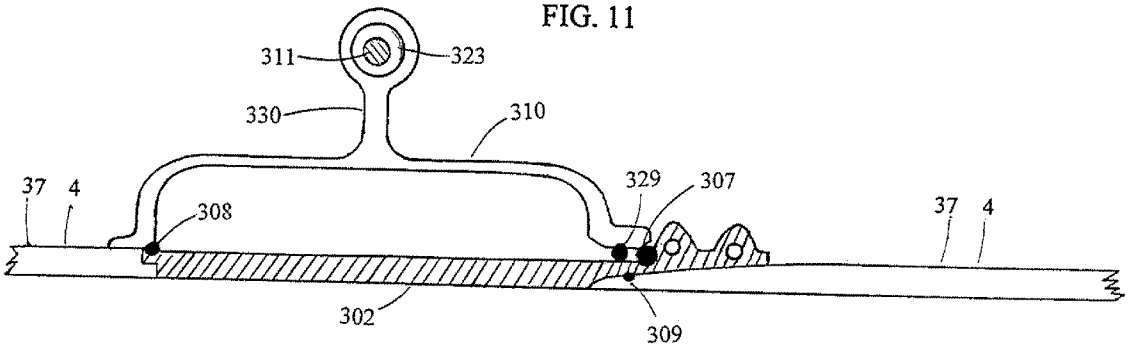
FIG. 11 is a cross section view of one embodiment of a jet tube housing and the glide door in the closed position showing how all four glide door gaskets seal and seat the glide door.
Figure 12:
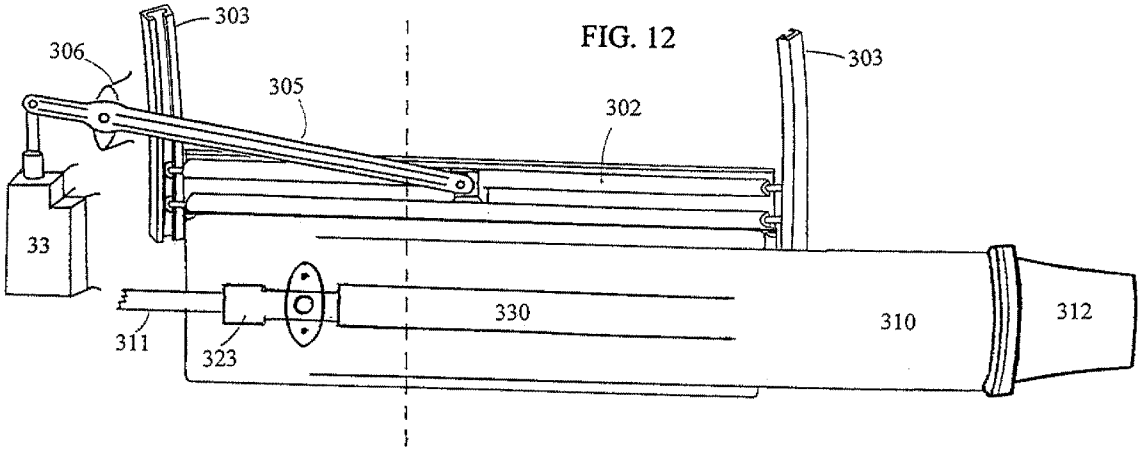
FIG. 12 is a top view of one embodiment of a jet tube housing and glide door in the closed position showing the dotted cut lines indicating where the jet tube housing is dissected to create FIG. 11.

FIGS. 11 and 12 are designed to demonstrate how the four intake door gaskets 307, 308, 309, and 329 seal water out providing 100% leak free water pump suction as well as seamless fitting of the intake doors 302.

FIG. 12 shows a top view of one embodiment of the first ever conceived self-sealing intake door 302 for a water jet propulsion system. This top view shows the glide door closed as it is shoved into the special sealed jet tube housing base 310. The outer pressure gasket 307 is seen compressed up against the jet tube housing 310 base shaped lower edge and the intake door 302 axle ridges. A side view of this outer pressure gasket 307 pressing the intake door 302 downward is seen in FIG. 11.

FIG. 11 is a cutaway view of the jet tube housing 310 seen in FIG. 12. The dotted, cut lines shown in FIG. 12 indicate where the jet housing is dissected to create FIG. 11 that shows how the intake doors 302 seal out water while traveling as well as when stopped and seated at the end of their stroke FIG. 11 shows the intake door 302 closed, bridging the gap between the inside and the outside of the frame opening 325 which is part of the molded MBD case 4 base 37. The inner pressure gasket 308 that is attached to the intake door 302 is seen causing down pressure to the intake door 302 to seat the intake door's stair step shape against the case bases 37 opposite stepped frame 325. The jet tube housing 310 provides a small angled shape where it meets up with the pressure gasket 308 that pressures the inside end of the intake door 302 downward at the outside end of the framed opening 325. The jet tube housing 310 also has a small angled shape at the outside edge to meet up with the intake door's 302 axle ridges. The two travel gaskets 309 and 329 are also seen in FIG. 11. The upper one 329 is attached to the MBD case's 4 base 37. These two travel gaskets 309 and 329 are responsible for keeping water out of the drive cabin 24 while the intake door is traveling in and out from the open to the closed position as well as sealing the jet tube housing 310 from leaks when the intake door 302 is in the open position to allow unfettered suction. This does require that both sides of the intake doors 302 must have smooth, even surfaces, with a consistent thickness so that when drawn by the gaskets 309, 329 a secure seal is possible. Another important shape matchup is where the intake doors 302 outer seat shape is not a stair step shape but an angled sharp edged curve. This shape allows the intake door 302 to be seated when closed as shown in FIG. 11.

Figure 13:
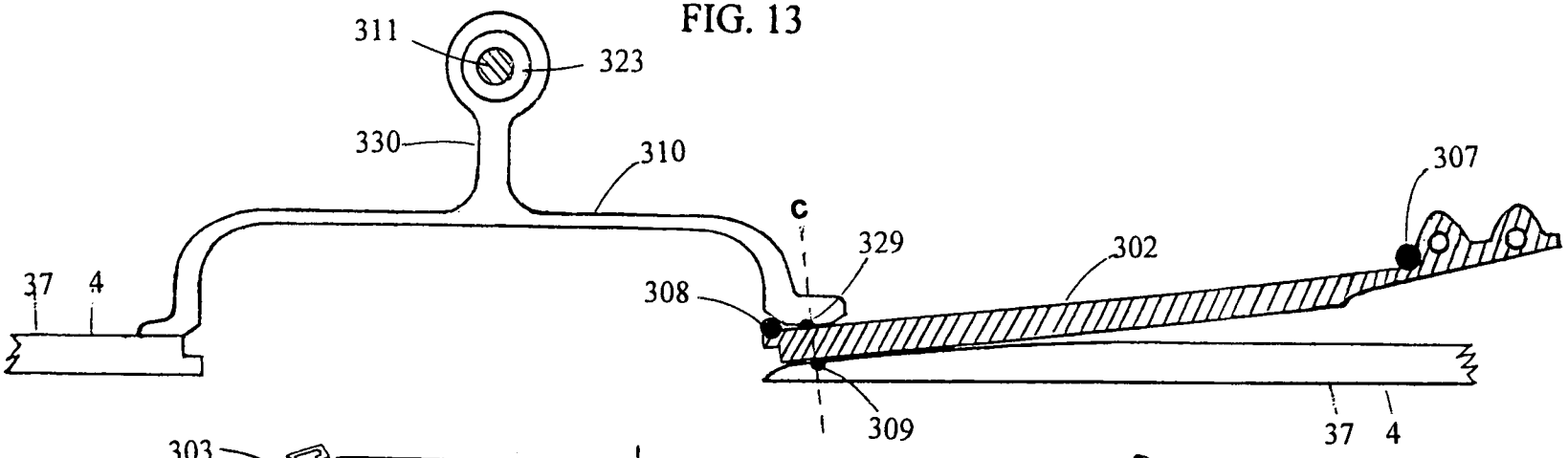
FIG. 13 is a cross section view of one embodiment of a jet tube housing and the glide door in the open position showing how the travel gaskets compress to seal out water. Travel gasket position line "C" is shown to understand where the gaskets lie hidden behind the jet tube base also shown in FIG. 14.

FIG. 13 is a cutaway view of the jet tube housing 310 with the intake door 302 all the way open. This view shows the upper 329 and lower 309 travel gaskets fully compressed. The cut line marked "C" shows where the drawing in FIG. 16 was created from, which is also shown in the horizontal cut line visible in the top view of FIG. 14.

Figure 15:
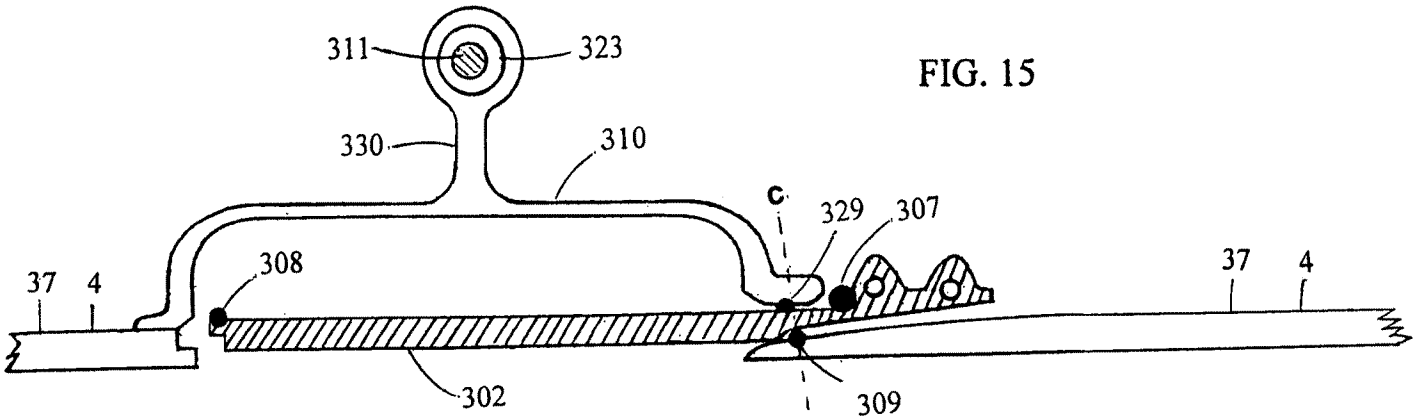
FIG. 15 is a cross section view of one embodiment of a jet tube housing and the glide door in the slightly open position showing the travel gasket fully compressed and the lower travel gasket partially compressed having not yet been passed over by the glide door's ramp edge.

FIG. 15 shows how when the intake door 302 is pulled out past the curved shape's edge, the upper travel gasket 329 is compressed to allow space for the dual smooth faced intake door 302 to step up and get drawn out of the perimeter framed opening 325 up the subtle uphill curve of the MBD case's 37, 4 base shape to eventually compress both the upper 329 and lower 309 travel gaskets providing a traveling waterproof seal as shown in FIG. 13. The lower travel gasket 309 is shown partially compressed.

Figure 14:
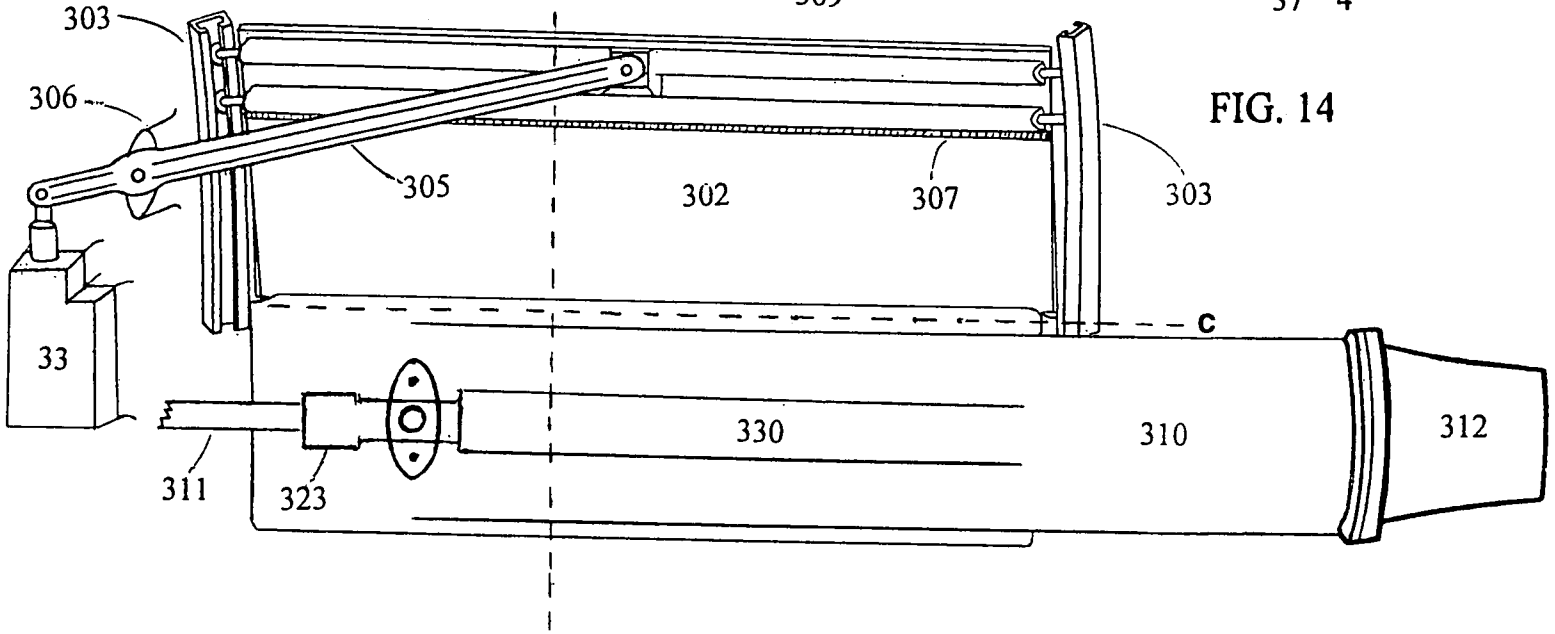
FIG. 14 is a top view of one embodiment of a jet tube housing and glide door in the open position showing the dotted cut lines indicating where the jet tube housing is dissected to create FIG. 49A. Also shown is the travel gasket position line "C" that runs the length of the perimeter opening positioned under the inside of the jet tube base.

FIG. 15 is a cutaway view of the jet tube housing 310 seen in FIG. 14. The cut lines shown in FIG. 14 indicate where the jet housing is dissected to create FIG. 15. FIG. 14 shows the intake door 302 open, as does FIG. 11. FIG. 13 shows both the upper 329 and lower 309 travel gaskets compressed against the intake door 302 providing a waterproof seal while the door is traveling in and out or when stopped as shown in FIG. 15.

FIG. 12 is a top view of the intake door 302 system integrated into the jet tube 310 housing showing the intake door 302 closed as it is shown in the aforementioned cutaway drawing FIG. 11 that was cut at the site shown by the dotted lines in FIG. 12. The other cut lines seen in FIG. 14 marked "C" are shown from where the cutaway drawing in FIG. 16 is created, which shows all the travel gaskets 309, 329, 328 in place.

FIG. 14 is a top view of the intake door 302 system integrated into the jet tube housing 310 showing the intake door 302 open as it is shown in the aforementioned cutaway drawing FIG. 15. The dotted cut lines show where the jet housing is dissected to create FIG. 15. The only gasket seen in FIG. 14 is the outer pressure gasket 307. The intake door 302 is shown all the way out to the end of its open stroke. The quick action linear actuator 33 is shown retracted to cause the door arm 305 to open the intake door 302 smoothly on its tracks 303.

Figure 16:
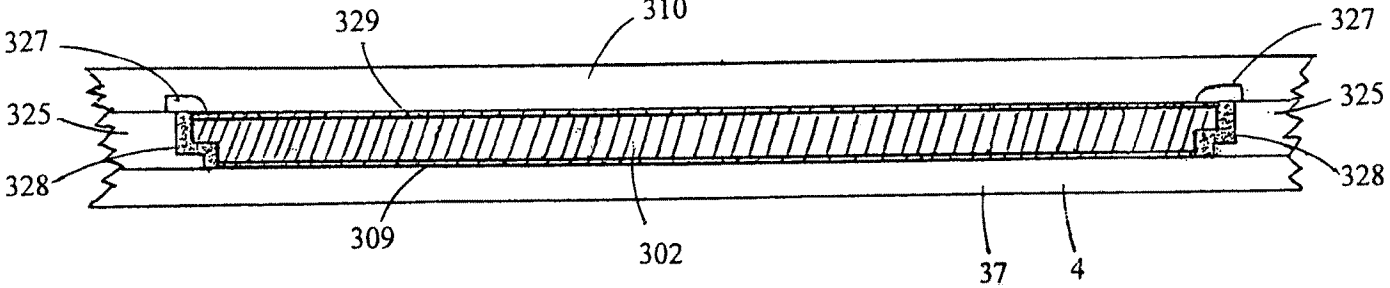
FIG. 16 is a cutaway end view of one embodiment of a glide door as it passes through the jet tube housing's base flange and the MBD case's base near the ramped edge of the perimeter opening showing the upper and lower travel gaskets and the two stair shaped end gaskets surrounding the smooth faced glide door.

FIG. 16 is a cutaway end view of the intake door 302 as it passes through the opening between the jet tube housing's base flange 310 and the MBD case's 4 base 37 at the ramped end of the opening. Dissecting (dotted) lines marked "C" shown in FIGS. 15 and 14 show where the end view drawing of FIG. 16 is cut and therefore created from FIG. 16 shows the full length of the intake door 302 with the stair stepped end gaskets 328 that are attached to the MBD case 4 base's 37 perimeter frame 325. These end gaskets 328 are also travel gaskets that seal out water at the ends of the intake door 302 when traveling as well as when stopped at the end of each stroke just like the upper 329 and lower 309 travel gaskets do. The end gaskets 328 butt up against the ends of the upper 329 and lower 309 travel gaskets which are seen in FIG. 17 compressed between the intake door 302 and the jet tube housing 310 and the case 4 base's 37 perimeter frame 325 at the ramped side.

Figure 17A:
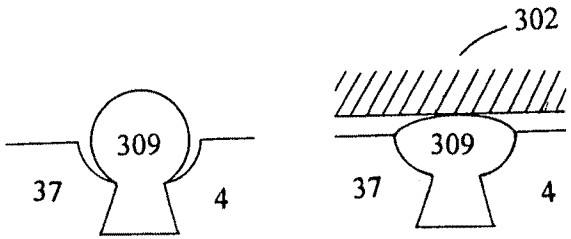
FIG. 17 is a cutaway close up view of one embodiment of an anchored gasket with a pressure relief basin shape molded into the case's base and the jet tube housing. The drawing on the left shows the gasket not compressed wherein the drawing on the right shows the gasket compressed. This drawing shows how these gaskets are capable of such a long reach while waterproofing.

FIG. 17 is a cutaway close up, end view of one embodiment of an anchored gasket with a pressure relief basin shape molded into the case 4 base 37. The gasket drawing on the left shows the un-pressed travel gasket 329, 309 sitting in the molded shaped case 4 base 37 perimeter frame 325. Notice how the round solid "O" shape of the gasket 329, 309 at the top turns into a flared-out square shape at the bottom. This bottom shape is the anchor that keeps the travel gaskets 329, 309 from popping out of the tight fitting flared shape provided in the case 4 base's 37 preferred hard plastic or fiberglass or carbon fiber material. Notice also how the case 4 base's 37 shape moves away from the "O" shape of the un-pressured gasket 309, 329. This is the pressure relief basin shape that allows the round shape to change as it fills up the lower level basin. This unique gasket and basin shape is how these travel gaskets 309, 329 can provide such a long reach of waterproofing ability. The other factor is providing the correct durometer of the rubber or urethane material that the gasket is made of. The preferred material should be somewhat malleable, tear resistant and have a resilient rebound quality to it. The pressured gasket 309 seen at the right of the drawing FIG. 17 shows the intake door 302 pressing the lower travel gasket 309 into the relief basin's shape and losing more than half its height which is also shown in FIG. 15 with the intake door pressuring both travel gaskets 309, 329 at the same time. This long reach gasket design is necessary to take up the variable space created in the transition of the intake door 302 moving from the shut position to the open position insuring a 100% waterproof fit. The transitional movements are shown in the close-up cutaway views shown in FIGS. 11, 13 and 15.

Figure 18:
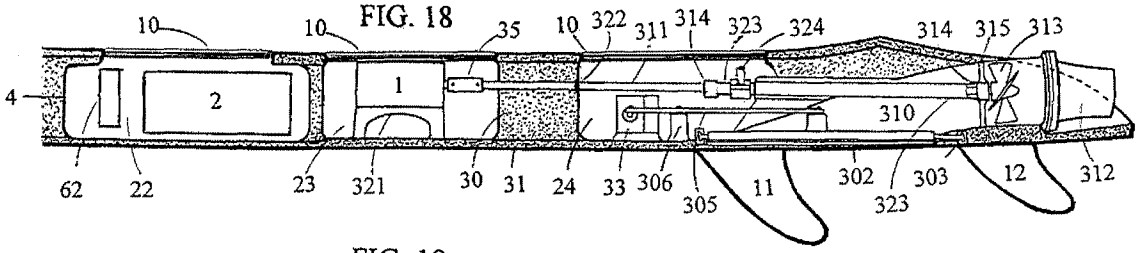
FIG. 18 is a close up cutaway side view of one embodiment of the port side of the jet drive surfboard showing all of the components inside the MBD case.

FIG. 18 is a cutaway side view of the present invention intake door, jet drive short surfboard's 3 showing the cabin, MBD cases 4 interior. The battery cabin 22 which is a dry cabin, is seen containing the control box 62 and shows the side of one of the two battery packs 2. A side view of the access cover 10 is also seen. The next cabin aft is the motor cabin 23 that is also a dry cabin. A brushless motor 1 is seen mounted on a stationary motor mount 321. The motor to shaft coupler 35 is seen within the cabin 23 that is connected to a fairly long shaft 311. The long shaft 311 is necessary to bring the motor 1 closer to the battery cabin 22 and therefore shifting the weight bias towards the center of the surfboard which is a designed-in measure taken to minimize the handling issues presented when adding significant onboard weight to a surfboard. The idea is to centralize the bulk of the weight between the rider's foot placements which are the surfer's two control points that steer and weight the board. Onboard weight placed outside the foot placements (anti-swing weight) reduces the surfboard's ability to rotate and makes the board seem heavy and sluggish when turning.

The next cabin aft is the drive cabin 24 which is mostly a dry cabin, however it may be subject to water droplets entering through the end of the shaft tube 323 if not properly greased. Also water droplets could enter through the glide door slot opening if debris gets caught in between the gaskets 309, 329 and the intake door 302 closing. This is why a screw on and off access cover 10 is provided to service the interior components. There is an "O" ring 322 provided where the shaft enters the wall that goes to the motor cabin 23. This will prevent water from entering the motor cabin 23 in the event of a mishap that could fill the drive cabin 24 with water.

A side view of the shaft 311 going into the bearing 314 ended shaft tube 323 that has a grease nipple 324 that allows grease injections to fill the space between the shaft 311 and the shaft tube 323 with grease for waterproofing as well as lubrication. The jet tube housing 310 is shown encompassing the shaft tube 323 as well as holding it in place to meet up with the shaft 311, tube 323, and bearing 314 holder 315 which is an inside tube, three spoked holder that centers the bearing 314 and shaft 311 that connects to the impeller 313. The jet nozzle's 312 semi cone shaped end is seen pointing down toward the water surface. The jet nozzle 312 is designed to be detachable to service the impeller 313 and the bearing 314.

FIG. 18 also shows a side view of the intake door 302 components located in the drive cabin 24. The high speed linear actuator 33 is connected to the door arm 305 that pivots in reverse by being pinned to the pivot arbor 306 that in turn moves the intake door 302 and rolls on the intake door track 303. The desirable twin foam and fiberglass construction 30, 31 is seen and is also provided inside the MBD case 4 between cabins 23 and 24. The 10 lb. foam skin 31 can be seen with fiberglass layers on each side of it. Carbon fiber would be even better. The preferred core foam would be a super light ¾ lb. styrofoam 30, but there are many different surfboard body constructions that would work. For instance; hollow with stanchions, wood skinned with ribs, single foam and glass, etc. The present invention makes no claims or limitations on what materials could be used to manufacture these designs.

Figure 19:
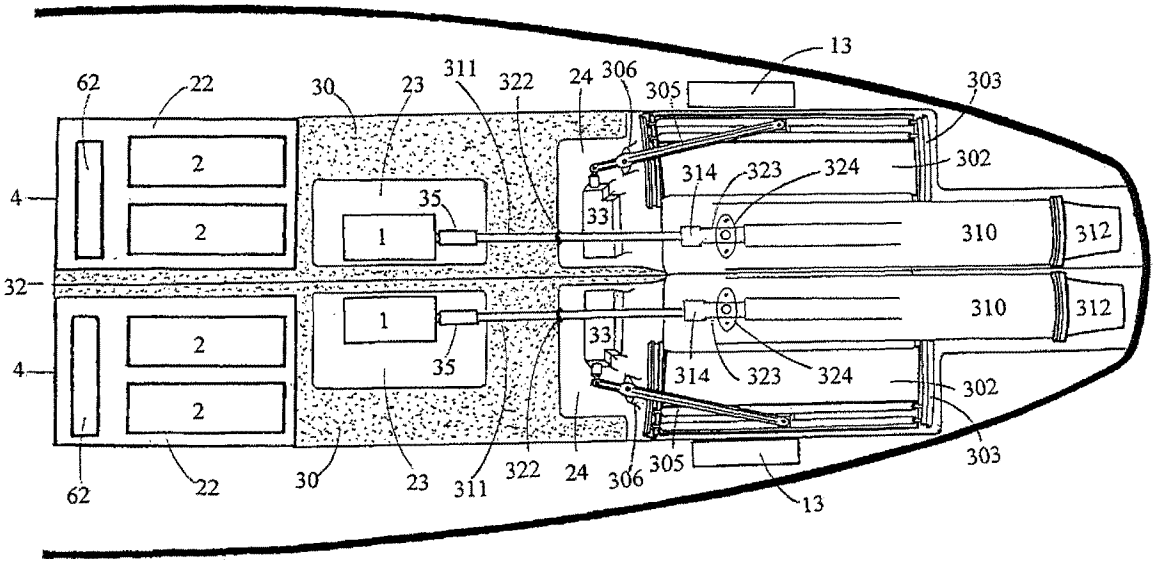
FIG. 19 is a close up see through top view of one embodiment of the jet drive surfboard showing how both port and starboard MBD cases fit within parameters of the modern short surfboard. Also showing the glide doors open with all the components inside both MBD cases.

The tail fin 12 and one of the side fins 11 are shown at their natural positions and are seen fitting nicely around the glide doors 303 in the top view drawing of FIG. 19 that shows the backside of the fin boxes 13 that connect the fins 11, 12 to the surfboard body.

FIG. 19 shows a see through top view of the aft half of the twin jet short surfboard 3 revealing all the working components within the two MBD cases 4 that can be compared by sight to the equal scale side view of FIG. 19 and shows how the jet tubes 311 intake doors 302 and the rest of the working parts fit within the parameters of a short surfboard 3. The hardwood stringer 32 is seen bonded between the two MBD cases 4. The four battery packs 2 are shown in the two battery cabins 22 next to the two control boxes 62. The two brushless motors 1 are seen in their separate cabins 23 with the couplers 35 attaching the two shafts 311 extending outside the motor cabins and into the drive cabins 24, then into the bearing 314 ended shaft tubes 323 and the grease nipple 324 then finally into the jet tube housings 310. The twin jet nozzles are seen side by side in a parallel line to each other. A top view of the intake door 302 setup is visible and easy to compare to the side view in FIG. 18. The linear actuators 33 are seen retracted and pulling the door arms 305 to pivot on the pivot arbors 306 to reverse direction and open the intake doors 302 that roll on the intake door tracks 303.

FIG. 20 shows a top view of one embodiment of the wireless control means preferred to operate the twin electric powered jet surfboard 3. A triangular shaped wafer is seen housing the radio receiver antenna 6 and an LED light battery gauge readout 20 that is flush fit into the surface of the surfboard 3 deck, preferably in the nose region as shown in FIGS. 2 and 6.

Naturally, wires are run inside the body of the surfboard 3 (not shown) from the triangle wafer to the control box 62.

Figures 35, 36:
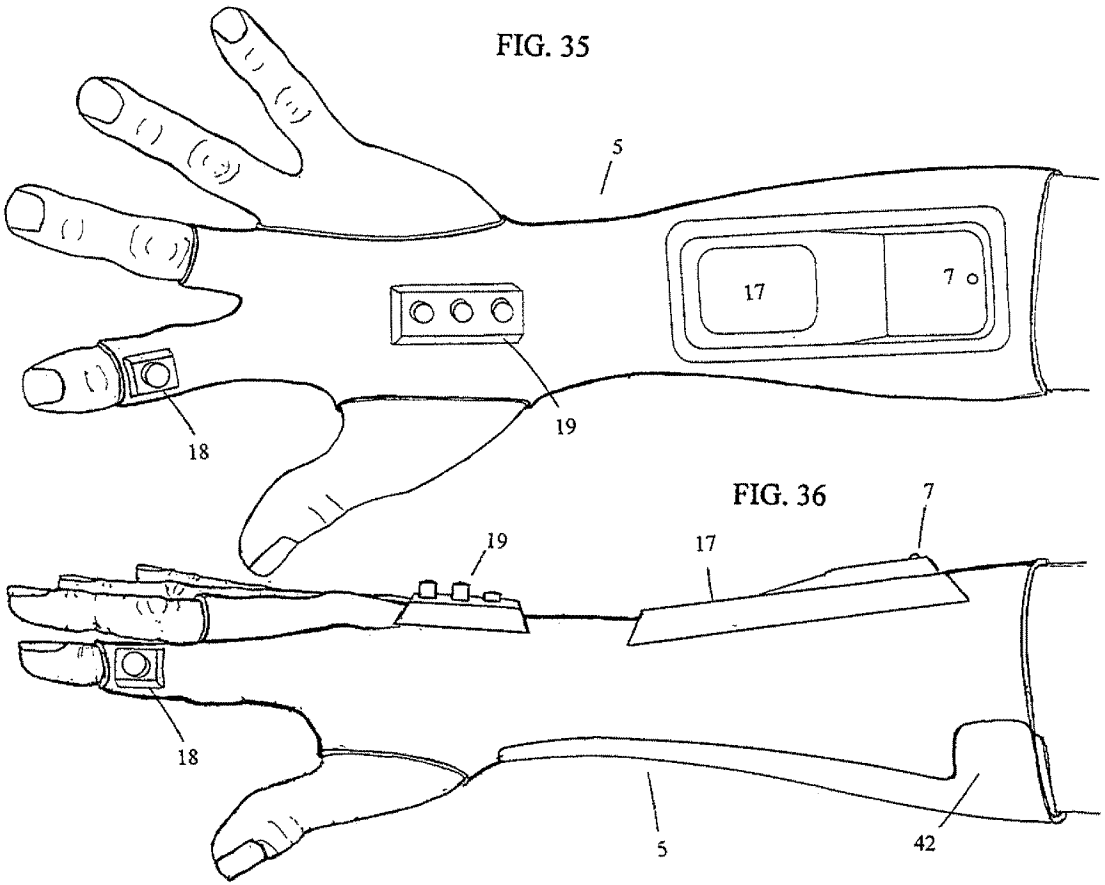
FIG. 35 shows a top view of one embodiment of a wireless control glove 5.
FIG. 36 shows a side view of the same wireless control glove 5 shown in FIG. 68.

FIG. 20 also shows the control glove 5 that transmits the desired signals to the aforementioned triangle receiver 6 via the transmitter antenna 7 signaling out of the transmitter and battery case 17 located on the wrist area of the control glove 5 that is constructed out of sewn and glued neoprene material as seen in FIGS. 35 and 36.

A thumb to the middle part of the forefinger button 18 is shown that turns the twin jet drives on and opens the intake doors 302. Also a three speed button control 19 is shown attached to the control gloves 5 top hand area. The buttons on this control 19 must be operated by a finger on the rider's opposite hand.

FIG. 22 shows a corner sample of the molded-in side wall seats of the MBD case base's perimeter 37. The step like moldings make it easy for the builder to glue up the motor battery drive case sidewalls 38, 39, 40, 41 the molded case decks 36 provide the same perimeter shape.

FIG. 21 shows a slanted top view of one embodiment of the rigid drive motor battery drive case 4, starboard side. This unit 4 is complete and ready to install into a surfboard body. Also shown are the four side panels 38, 39, 40, 41 of an unassembled motor battery drive case. These panels represent a custom option for the individual surfboard builder. They are shown oversized and unattached to the MBD base 37, 320 and deck 36. The individual builder preferably should be able to order the MBD cases 4 fully assembled with the pre-determined rocker and side thicknesses bonded and ready to install. Or, a builder could order the MBD cases un-assembled and actually cut their provided side panels to their preferred specifications. This frees up the builder to motorize just about any surfboard shape by being able to make the MBD case 4 fit a desired thickness plan shape, accommodating different size motor 1, batteries 2, and interior components that would determine the finish thickness of the surfboards body 3 within the crowned deck 25 prone and standing area.

A continuous rocker must be molded into each case base 37 because it 37 must remain semi rigid for the motor cabin 23 and the drive cabin 24 to sustain free movement of the working parts involved. This is why at least three different continuous rocker curves should be offered to the surfboard builders. This should be sufficient because the difference in rocker curve over the short length span of the two cabins 23 and 24 is less than one half inch. This covers the "within" measurement of almost all surfboards made. So a manufacturer marketing three different rocker curves varying at one eighth inch increments should cover the field. Considering the forgiving fact that the case base 37 can be bent slightly for final bonding and the builder can use small amounts of fairing compound to blend any slightly unmatched high and low glue lines that may occur when bonding the MBD case 4 into the surfboard body. The case deck 36 should be manufactured more flexible than the case base 37 so it can follow the slightly different custom curves before bonding it to the case sides 38, 39 once the case deck 36 is bonded to the case sides 38, 39 and therefore bonded to the case base 37. The deck 36 becomes more rigid and altogether strong enough for a full grown man to stomp on without incident.

The case deck 36 is seen in FIG. 21 with three access covers 10. They allow waterproof access to the motor cabin 23, the battery cabin 22 and the drive cabin 24. The case deck 36 should be built with the access cover's 10 threaded openings also preferably molded into the deck 36 to provide a consistent flush fit when the covers 10 are tightened down, with one caveat . . . the covers 10 have to stand slightly proud to allow space to put down laminates of fiberglass needed for construction to integrate the MBD cases into a surfboard body.

The same step shaped sidewall seats that are molded into the case base 37 should be molded into the case deck 36 making it simple for the builder to squarely match up and glue the deck 36 to the sides 38, 39 ends 40, 41 and base 37 (shown in FIG. 22). The preferred material to produce the MBD cases would be a high density foam or lightweight wood with fiberglass laminate on each side. The molded base 37 and deck 36 will vary in thickness between $\frac{1}{8}^{th}$ and ½ inch while the sidewalls 38, 39, 40, 41 should be at least $\frac{1}{8}^{th}$ inch thick.

FIG. 23 shows a slanted top view of the same motor battery drive case 4 shown in FIG. 21 with the case deck 36 removed for interior component viewing. The cover sites are shown 10 to understand their preferred location over the rigid drive components in cabins 22, 23 and 24.

Figure 24:
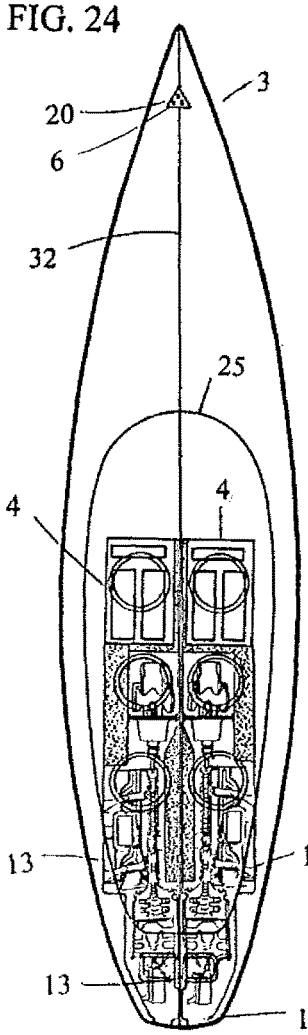
FIG. 24 shows a see through top view of a twin disappearing flex drive motorized short surfboard 3 that displays all the interior components inside the MBD (Motor Battery Drive) cases 4.

FIG. 24 shows a see through top view of a twin retractable flex drive motorized short surfboard 3. The hardwood stringer 32 is shown running the length of the surfboard 3 and bonded to the two MBD cases 4. The crowned deck 25 perimeter is shown designating the prone/standing area. The six access cover 10 locations are indicated by double lined circles and the two aft access covers 110 are indicated by double lined squares. The two bilge vents 112 are seen exiting the MBD 4 cases on either side of the stringer 32.

The three fin boxes 13 are shown nestled between the MBD cases 4 also shown is the wireless receiver antenna 6 and the battery gauge display 20 in the triangle wafer that is flush fit into the surfboard 3 deck at the nose.

Figure 25:
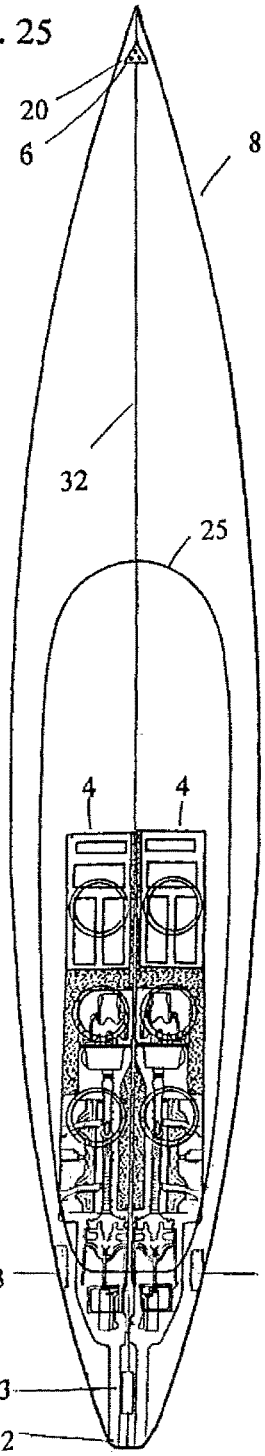
FIG. 25 shows a see through top view of a twin disappearing drive 101 motorized Waimea Gun surfboard 8 that displays all the interior components inside the MBD case 4.

FIG. 25 shows a see through top view of a twin retractable rigid drive motorized Waimea Gun surfboard 8. The hardwood stringer 32 is shown running the length of the surfboard 8 and bonded to the two MBD cases 4 the elongated crowned deck perimeter 25 is shown designating the prone and standing area. The six access covers 10 locations are indicated by double lined circles and the two aft access covers 110 are indicated by double lined squares. The two bilge vents 112 are seen with extension tubes extending out the extra length to the tail end on either side of the stringer 32 to either side of the fin box 13. The two side fin boxes 13 are shown outside the MBD case 4. Also shown is the wireless receiver antenna 6 and the battery gauge display 20 in the triangle's wafer that is flush fit into the surfboard 8 deck at the nose. This Waimea Gun twin rigid drive surfboard 8 is designated to achieve top speed with the power on in order to drive into 20' to 50' waves. This 10'4" gun is narrow and long providing good flotation with minimal drag. The board can power forward fast enough to allow the rider to stand up while fielding and ultimately catching huge, fast moving ocean swells.

Figure 26:
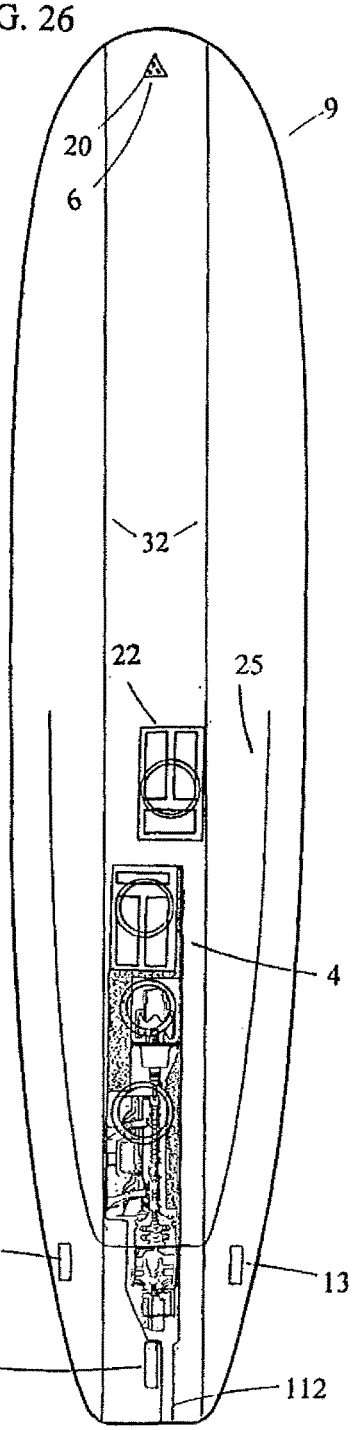
FIG. 26 shows a see through top view of a single disappearing rigid drive 101 motorized longboard/paddleboard 9 that displays all the interior components inside the MBD case 4 plus the extra battery cabin 22.

FIG. 26 shows a see through top view of a single retractable rigid drive motorized longboard/paddleboard 9. Two hardwood stringers 32 are shown running the length of the surfboard 9. Bonded to the port stringer 32 is the MBD case 4. Also shown is an extra battery cabin 22 that is bonded to the starboard stringer 32. This design centers the rigid drive 101 at the propeller 26 or impeller 29 as well as the weight distribution. The crowned deck perimeter 25 is shown designating the aft prone paddling and standing area. The fore deck shows the crowned deck 25 fading out into a non-stepped, slightly thicker than normal deck area. This design is necessary on a longboard shape to allow the surfer to walk the board and hang toes over the nose which is a core move in longboard surfing. The MBD case 4 indicated by double lined circles and the one aft access cover 110 is indicated by double lined squares. The single bilge vent 112 is seen with an extension tube extending it out to the tail's end on the starboard side of the tail fin box 13. The two side fin boxes 13 are shown outside the two hardwood stringers 32. Also shown is the wireless receiver antenna 6 and the battery gauge display 20 in the triangle wafer that is flush fit into the surfboard deck 9 at the nose.

This longboard/paddleboard single drive surfboard 9 shows how versatile the MBD case 4 is for the surfboard builder. A single drive is all that is called for in this 10' long paddleboard. It is not a board that is seeking a top speed. Rather, this board is designed for stand up paddling with electric motor assistance or prone paddling with electric motor assistance with the intent to cruise at slow speeds while conserving energy with the capability of long run times. The three extra battery packs contained in cabin 22 can extend the run time considerably.

Figure 27:
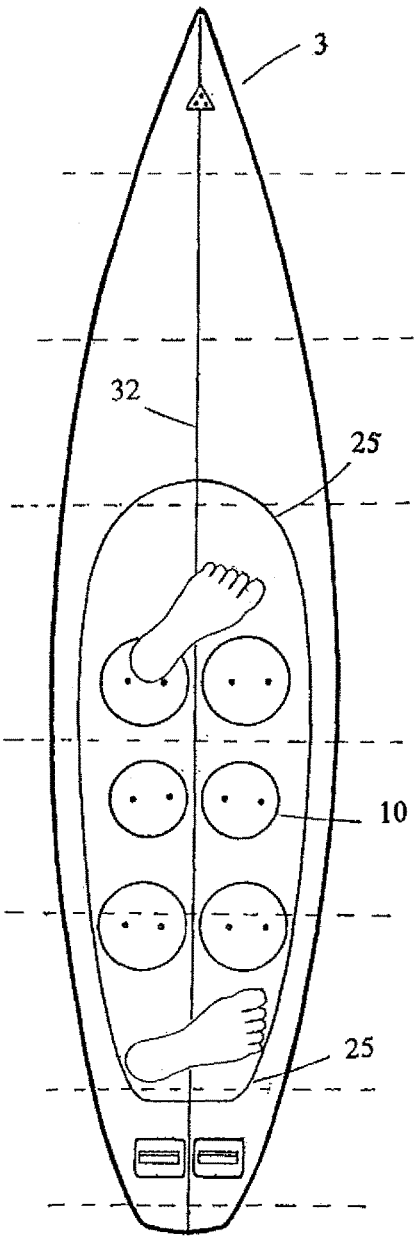
FIG. 27 is a top view of the twin jet propelled short surfboard 3 showing the foot placements as well as dotted cut lines indicating where the cutaway thickness profile samples seen in FIG. 63 are cut.
Figure 28:
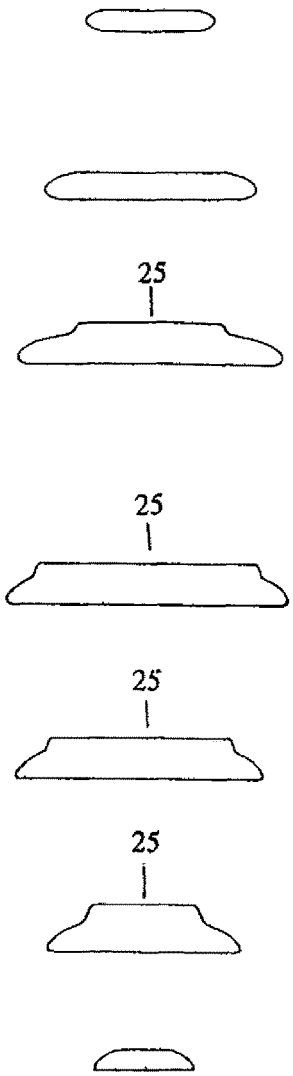
FIG. 28 shows seven cross-cut thickness profile samples taken from FIG. 62 displaying the unique crowned deck profiles.

FIG. 27 is a top view of the dual jet drive short surfboard 3. The stringer 32 is seen running the length of the surfboard 3. The crowned deck perimeter line 25 shows where the raised deck edge begins and ends. Dotted cutout lines are shown to indicate where the cut profile samples seen in FIG. 28 are cut. The six access covers 10 are shown between two foot placements in a regular foot stance (left foot forward). These foot placements represent where an adult surfer would stand on a short modern surfboard.

Figure 29:
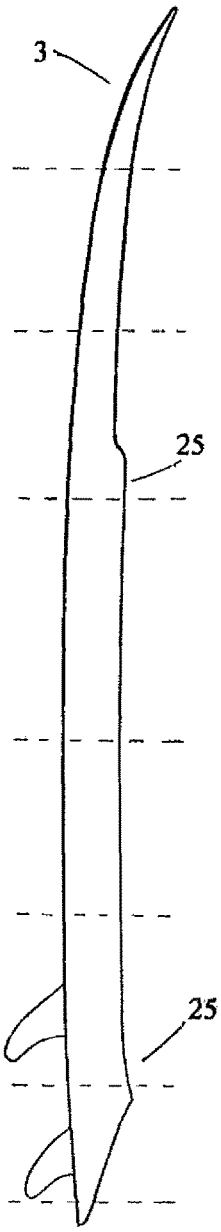
FIG. 29 is a side view of the same twin jet propelled short surfboard 3 shown in FIG. 27. This shows a comparison to help understand where the cut lines are stationed to show the crowned deck 25 thickness samples in FIG. 28.

FIG. 28 shows seven cross cut thickness profile samples taken from the stations indicated by the dotted cut lines shown in FIGS. 27 and 29. These thickness samples show the rail shapes and in particular the crowned deck's 25 unique profiles. The first two from the nose show an average surfboard thickness. The next one down shows the forefront of the crown shape 25. The next sample down at the middle of the surfboard 3 shows the crowned deck 25 shape that allows a thin railed wave print from an extra thick surfboard body 3. The thickest part of the rail is inset from the edge just far enough for the water to flow over the thin portion without bouncing off the thick portion when the board is planed up and turning. The next lower thickness sample 25 shows about the same inset as the midships sample above it, which is approximately the minimal amount of inset that is functional. The next lower crowned deck 25 sample is the thickest part of the surfboard which is the rear foot kick tail area.

A plurality of design variables are possible with the present invention's crowned deck 25 being added to an otherwise thin railed 2¼" thick surfboard body. For instance, there's the amount of inset on rail; the amount of kick tail; the amount of front foot kick; the amount of overall thickness lengthwise across the crowned deck. Then there's the correct shape at the hand grab site 63 FIGS. 30, 31 to facilitate maximum hand grip while maintaining the basic inset 25 dimensions and shape. There's also the longitudinal or latitudinal convex or concave subtle curves on deck that may be preferred by certain surfers. This would call for curved access covers. The aforementioned are all design factors of the crowned deck 25 that can be custom tailored to the individual surfboard shaper's and builder's designs.

FIG. 29 shows a side view of one embodiment of the dual jet drive short surfboard 3. The main purpose of this view is to compare cut lines FIGS. 27 and 28. The crowned deck 25 is shown in one of many different possible deck thicknesses. This one is seen as relatively flat lengthwise and is the same from port to starboard making it possible to use the circular screw-on access covers 10. If some custom contours are desired the rider can use rear foot pads (not shown) which are applicable and welcomed on the present invention's crowned deck 25. These after market rear foot pads (not shown) provide traction and can be trimmed with a razor to stick on top of the deck where it crosses over the circular access covers 10 that need to be able to spin. The kicktail shape is optional on this jet drive design.

Figure 30:
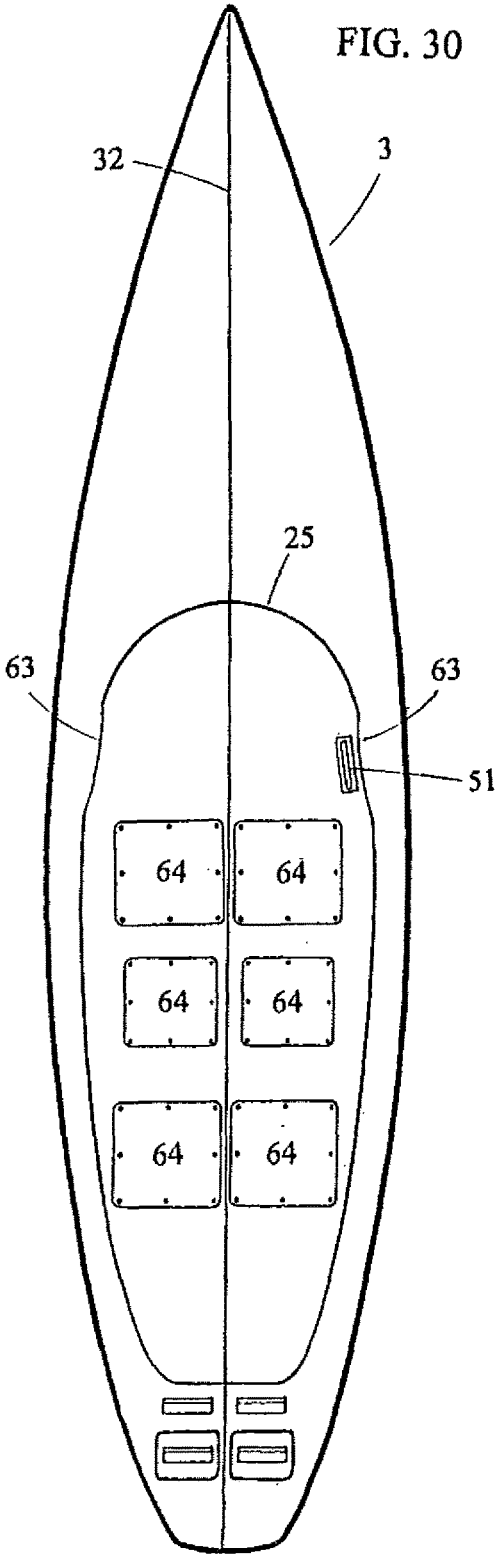
FIG. 30 is a top view of the twin jet propelled short surfboard 3 version with hand landing grip areas 63 with an elongated manual on/off clicker button 51 as well as the contoured deck covers 64.

FIG. 30 shows a top view of the dual jet drive short surfboard 3 with hand landing and grip areas 63. These grip areas have softened ridge shapes on the crowned deck 25. These flatter shapes conform better to the palm of the hand. These landing areas 63 are forward of the center of the board so they don't interfere with the water flow on the rails when planed-up and turning. Encased in the middle of the right hand grip area 63 is an elongated on/off button 51. One downward push on this button 51 will shut off the motor 1, and shut the intake doors 302. This all happens just as the surfer grabs the rail and deck 63 to push up with his arms to go from a prone to a standing position which is at the same instant he has caught the wave and is dropping down the wave face.

This manually operated button 51 eliminates the need for a more expensive wireless control means but limits the operation to a single speed, either on or off. The elongated button 51 has a flush fitting case with a slightly raised clicker button that is spring loaded to bounce back and reset after clicked and released. The button 51 and case are of course water proof and the long shape makes it easy to aim at. The next time the clicker button 50 is pressed it will open the intake door 302, push down the rigid drive train 101 and turn the power on.

FIG. 30 also shows a top view of a crowned deck 25 that may have subtle deck curves in the prone and standing area. Therefore, the circular screw-on covers 10 won't work. Instead, curved access covers 64 that pull straight up must be used. The square outline shape of the covers 64 shown in FIGS. 30 and 31 are one embodiment of access covers that could be used, but must be fastened with multiple flathead machine screws and waterproofed by O-ring gaskets.

Figure 31:
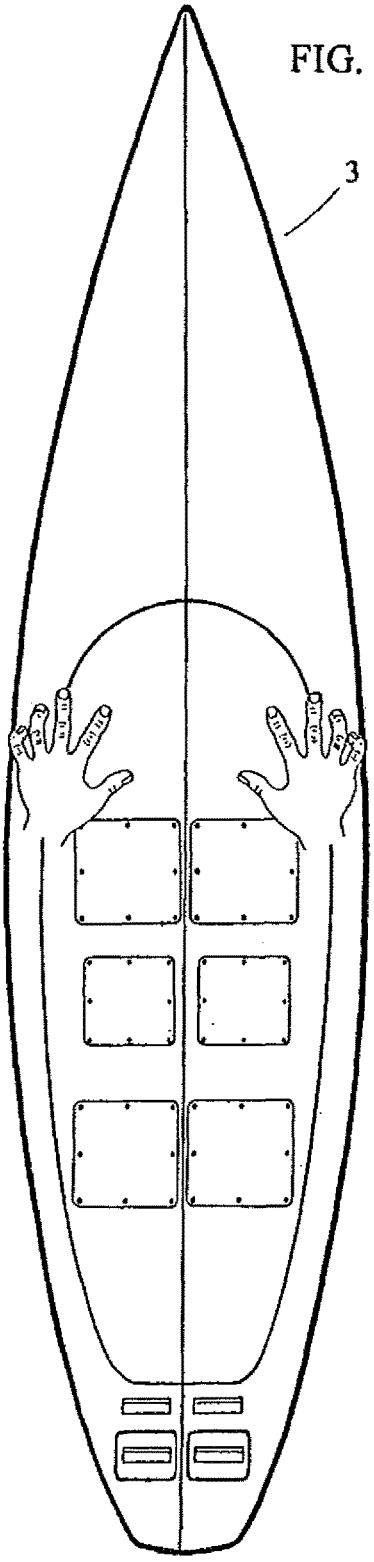
FIG. 31 shows the same top view of the twin jet propelled short surfboard 3 as in FIG. 30 but with hands placed on the hand grip areas 63.

FIG. 31 shows the same top view of the jet propelled short surfboard 3 as in FIG. 30 but with hands placed to show them in the act of pushing a surfer up to the standing position while at the same time clicking the on/off button 51 to retract the rigid drive trail 101, shut off the power, and close the intake door 302.

All the different versions of the crowned deck design 25 outlined in FIGS. 24, 25, 26, 27, 28, 29 and 31 have one thing on common; they have a raised deck to accommodate interior components and increase flotation, with an inset maximum thickness at the side rails to maintain a thin railed wave print. The crowned deck 28 shapes outlined in this application are just a few of the many possible embodiments. Some version of the crowned deck 25 will always be necessary if the surfboard designed is to retain fine wave handling traits by making the wave print of a two and a half inch thick surfboard and because of the space needed for large interior components that also require extra flotation for the added onboard weight needed to be addressed. This crowned deck 25 design faces reality and solves two problems for motorized surfboards.

Figures 32, 33, 34:
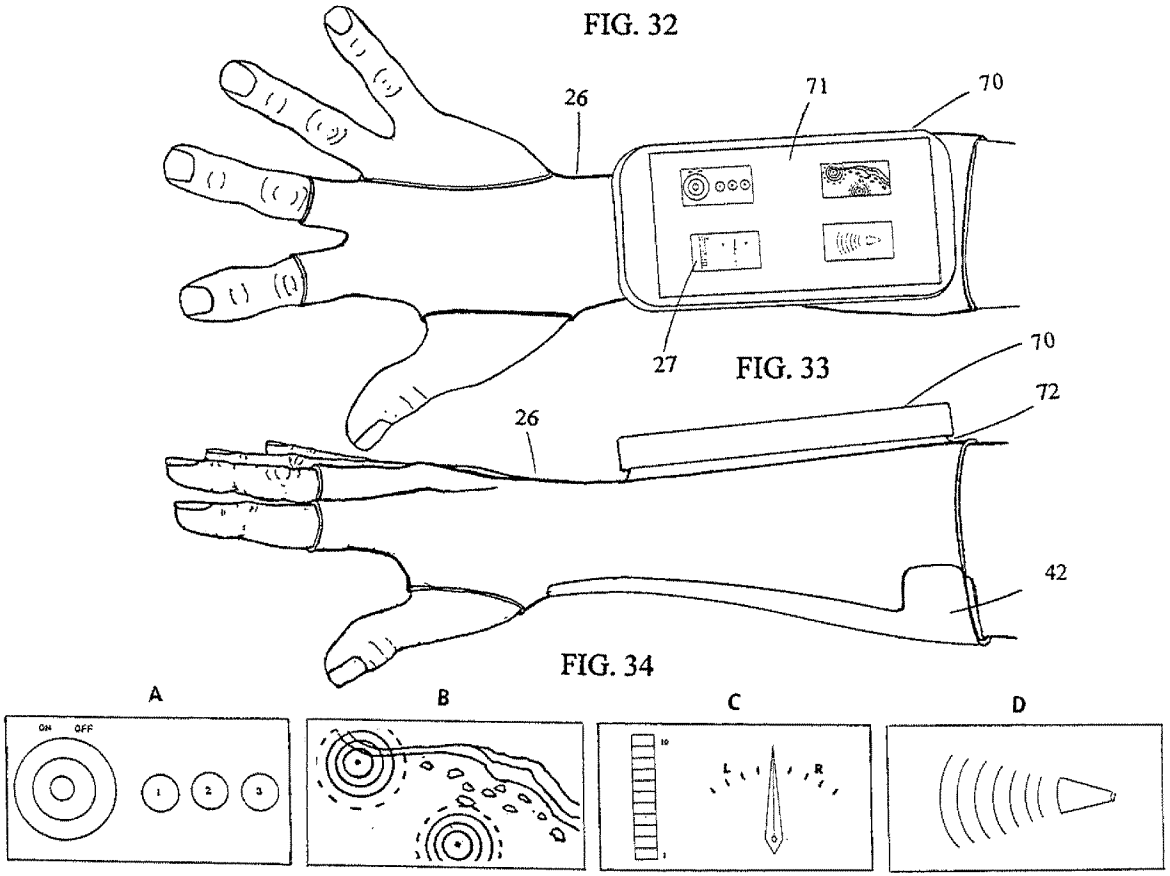
FIG. 32 shows a top view of one embodiment of a smart phone wrist mount glove 26 with four icons showing on the display screen app 27.
FIG. 33 shows a side view of the same smart phone wrist mount glove 26 revealing the Velcro entry flap 42.
FIG. 34 shows four different control icons that can be included in the electronic surfboard control app 27.

FIG. 32 shows an overhead view of one embodiment of a smart phone wrist mount 26 for surfing. This high security wrist mount 26 features a one piece neoprene half glove connected to a short forearm band. The half glove is anchored firmly to the hand and wrist by at least two finger through holes combined with a Velcro faced entry flap 42 that carries past the wrist to the mid forearm. This design combo keeps the mount from twisting around from its desired placement on top of the wrist. The clear waterproof case 70 with touch screen and voice command capability is shown surrounding the smart phone. Also, the smart phone is preferably placed aft of the wrist to allow full hand movement. The smart phone screen in FIG. 32 is showing one embodiment of a custom, wireless app menu with icons for electric surfing.

The two finger through holes and open thumb, index and pinky design resembles a half glove connected to an armband. This stabilizes the glove 26 from twisting around. Otherwise, securing a single arm band tight enough to keep it from moving around during a white water thrashing after a wipeout may cut off blood circulation to the hand. Also, a Velcro smart phone wrist mount could be integrated into a wetsuit for winter surfing.

FIG. 33 is a side view of one embodiment of a smart phone wrist mount glove 26. The solidly constructed neoprene or similar material one pieced glove 26 shows the Velcro entry flap 42 closed and secure. The smart phone 71 is placed inside a waterproof case 70 that does not inhibit the cell phone's touch screen or voice command capability. The waterproof case 70 is placed atop the wrist and forearm on an even plane with the top of the hand to avoid unwanted bumping. The case 70 is seen mounted on a flat Velcro covered face 72 enabling different smart phones and Velcro backed cases to be easily mounted and detached.

FIG. 34 shows four embodiments of the many different possible wireless control icons that could be included in an electronic surfboard control app 27 made possible through Bluetooth tethering and wireless smart phones. However, a longer range communication signal between the surfboard and the smart phone would be desirable similar to the strong signal provided by the R/C wireless setups outlined in FIGS. 35, 36, 40, and 41.

FIG. 34A shows one embodiment of a motor control touch screen that enables the surfer to field, catch and ride waves. It provides one big, easy to hit on/off button and 3 different speed settings.

Figure 39:
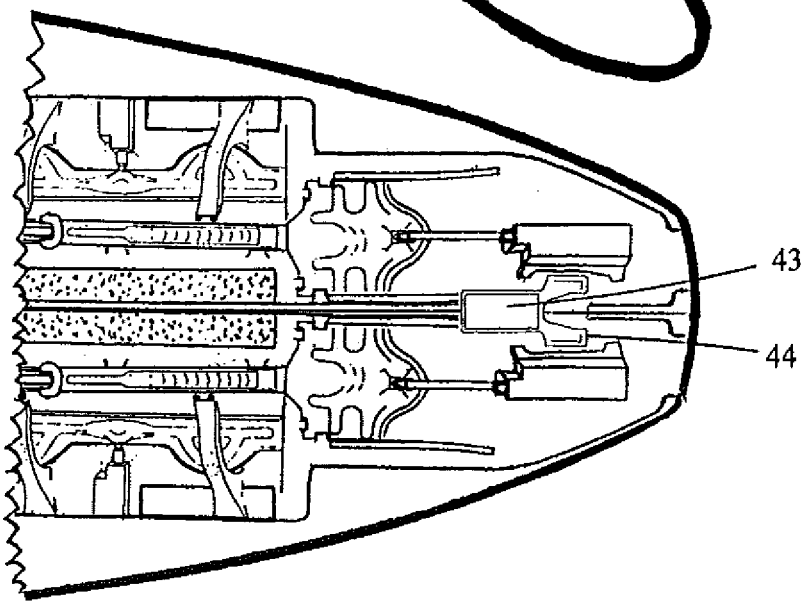
FIG. 39 shows a top view of the rudder servo 43 and stand 44.
Figure 40:
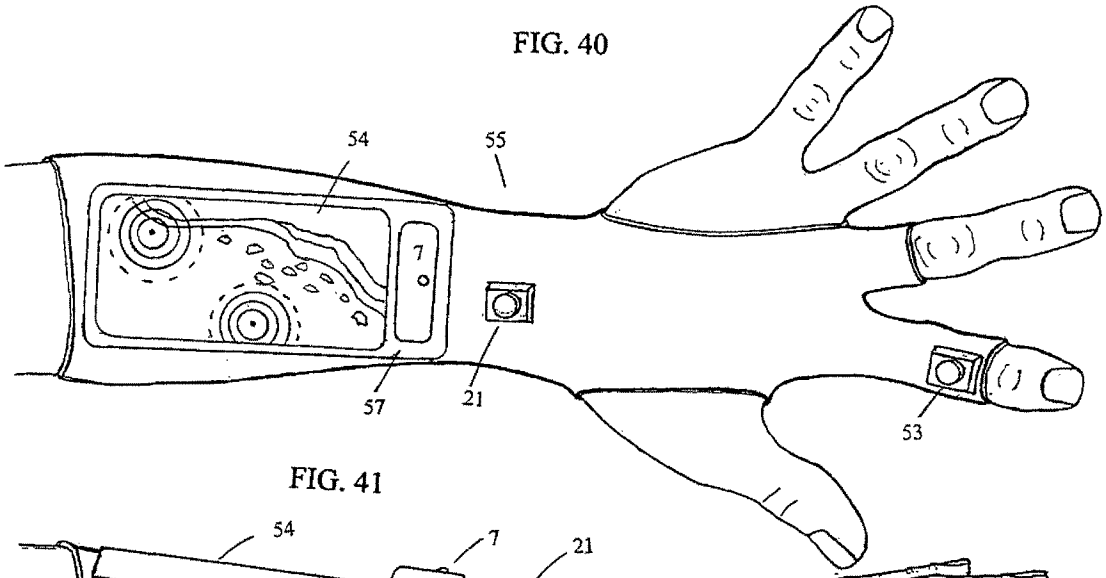
FIG. 40 shows a top view of one embodiment of a surfboard recovery glove 55.

FIG. 34B shows one embodiment of a GPS recovery screen 54 that allows the surfer to see an overhead view of his location in relation to the surf break and shoreline, like the one shown in FIG. 40. This Bluetooth, smart phone wireless app 27 does the same thing as the radio controlled GPS recovery system shown on FIGS. 40 and 41 using the same steerable rudder and servo system in FIGS. 37 through 39. But instead uses wireless Bluetooth tethering to replace the radio frequency, dead stick homing beacon technology outlined in FIGS. 37 through 41. This too enables the surfboard to steer itself back toward the smart phone carrying surfer.

The smart phone GPS map screen should also include a touch screen override button (not shown) to remotely shut the surfboard on or off to avoid set waves or obstacles.

FIG. 34C is one embodiment of a ghost rider motor and rudder control touch screen that mimics a two channel R/C kit enabling the surfer to maneuver the surfboard around without him on it, for various reasons. This is possible by directing a Bluetooth wireless signal to operate the servo and rudder system outlined in FIGS. 37 through 39. The touch screen display has a proportional throttle scale that shuts the motor off at zero speed. Plus, a left, center, right arrow dial that steers the surfboard by finger movement from the opposite hand. This allows the surfer to motor around and steer the surfboard without being aboard the surfboard (ghost ride) or the surfer could stand or lay prone on it if desired.

FIG. 34D shows one embodiment of a voice command feature app that can display voice commands in text form as it carries them out. It should also display the smart phone's vocal response such as iPhone's Siri does. This voice command feature could eliminate the need to touch the screen for the first three icon page functions outlined in FIGS. 34A, B, and C. However, it would be desirable to have both touch screen as well as voice command options.

FIG. 35 shows a top view of one embodiment of an R/C wireless control glove 5 fit over a right hand. This view shows the control means to operate the rigid drive 101 (not shown) and flex drive 201 (not shown) or a jet drive 301 motorized surfboard 3. It is preferably made out of neoprene wetsuit material. The optional design of covering at least two fingers is a minimal configuration meant for warmer waters of summer conditions though it could be stretched to fit over a winter wetsuit and glove. The overall length extends from the glove's ⅔ covered forefinger all the way up the wrist past the middle of the forearm. The extra length is necessary to hold the waterproofed wireless transmitter and battery case 17 that is positioned on the top of the wrist. This is important because the top of the wrist is level with the top of the hand which is unlikely to accidently bang up against or involuntarily touch the surfboard when grabbing the rail to push up. The three speed control 19 is shown center mounted on the top of the hand. This button 19 allows the surfer to set one of the three speed settings at a time and therefore three different rates of battery drain. The speed control button 19 is designed to be pressed by a finger on the opposite hand.

The specially placed on/off button 18 is seen at the midpoint of the forefinger between the top and the side. This exact position allows the thumb of the same finger to press the button 18 on and off and it is less susceptible to accidental or unwanted pressing. The button 18 position is in line with the top of the hand like the other components 19, 17, 7 and won't contact the surfboard when the surfer reaches to grab the rail and push up from a prone to a standing position.

FIG. 36 shows a side view of the same wireless control glove 5 shown in FIG. 35. The clicker type on/off button 18 is shown mounted at the perfect spot to be pressed by the thumb without being activated by a rail grab. When the water proofed clicker type button 18 is pushed it sends a signal through the transmitter antenna 7 to the surfboard's receiving antenna 6 located at the nose of the surfboard 3 then travels down a wire (not shown) on the stringer 32 to the control box 62 containing the speed control 19, the wireless receiver 15, and the micro circuit controller 16. Then the signal travels to the glide doors 103, 106 opening them first, then to the rigid drive servo 107 dropping the drive train 101 into the water as it turns on the motor 1.

When the clicker button 18 is released it resets itself to be pushed again. The next time it gets pushed it repeats the aforementioned sequence in reverse retracting the drive train 101 and shutting the glide doors to ride a wave.

The speed control buttons 19 are preferably raised off the case surface when inactive and flush when pushed, therefore activated. Also, when one button is pushed the one next to it will push up automatically and turn off. This is just one embodiment of a speed control 19 but its placement is critical to this type of hand control. The Velcro cuff strap 42 is shown in this side view. It provides a re-closeable split in the control glove 5 making it easy to take it on and off as well as a way to make one size fit all.

Figure 37:
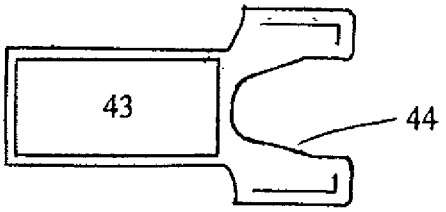
FIG. 37 shows a top view of a servo 43 encased in a special rudder steering servo stand 44.

FIG. 37 shows a top view of one embodiment of a return servo 43 encased in a special servo stand 44 that hovers over the center fin 12 to control it to steer the surfboard wirelessly back to the surfer that lost it.

Figure 38:
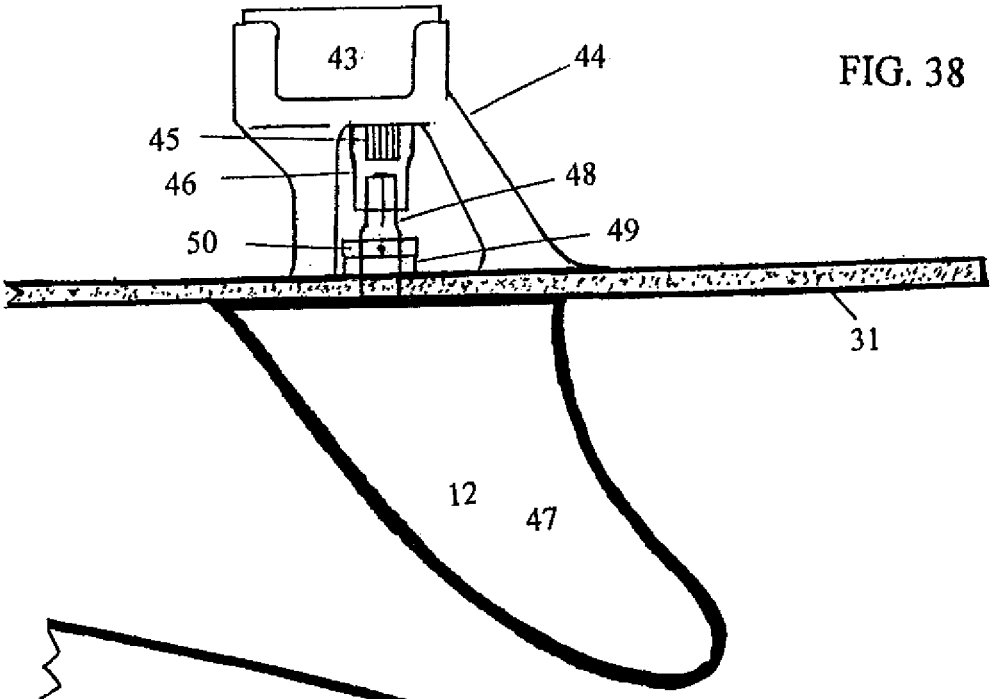
FIG. 38 shows a side view of a top mounted 44 servo 43 driven rear surfboard fin 12 turned into a rudder 47.

FIG. 38 shows a side view of one embodiment of a top mounted 44 servo 43 driven rear surfboard fin 12 turned into a rudder 47. The fin 12 which is now a rudder 47 has a post 48 that penetrates the MBD case 4, 31 through a hole. A thick post base washer 49 fits over the post 48 and is caulked to the inside of the case 4, 31 and has an O-ring (not shown) to stop water from gushing into the drive cabin 24. A collar 50 is fitted over the post 48 on top of the base washer 49 and has a set screw to lock the collar 50 in place. Therefore setting the rudder fin 47, 12 in place allowing it to turn on command. The rudder post 48 has a square top that fits into a female square socket shaped connector 46 that fits over the multi-tooth servo crank 45. This construction allows the electronic servo 43 to take commands from a dead-stick tracking program, wired into the micro circuit controller 16 located in the control box 62 which is located in the dry battery cabin 22. The commands are transmitted from the surfboard recovery glove shown in FIGS. 40 and 41.

FIG. 39 shows a top view of the rudder servo 43 and stand 44 that hovers over the fin 12 rudder 47 and post 48 showing how the optional recovery system can fit between two MBD cases 4.

FIG. 40 shows a top view of one embodiment of a surfboard recovery glove 55 worn on a left hand. This recovery control means has a thumb to forefinger button 53 that activates the GPS screen located on the top of the wrist and forearm on the same plane as the top of the hand. This is important because the component's buttons are less likely to be accidently pressed and won't activate on a rail grab when the rider pushes up to a standing position. The GPS screen 54 can display an aerial view of the surf spot and shore line where the modern wireless motorized surfer is surfing. It can display the location of the surfboard in the event the surfer gets separated from it. This informs the surfer if the board is already on the beach, on the rocks or anywhere in between. When separated from the surfboard a surfer has limited visual scope because his eyes are just a few inches above the surface of the water and often has difficulty locating it. The GPS screen 54 solves this dilemma. He can press the screen button 53 then watch the GPS screen 54 showing a target marker where the surfer is and a target marker where the surfboard 3 is. When the surfer presses the return button 21 and the on/off button 18 the dead-stick tracking program is activated and he can then watch on the screen as the board marker moves closer to his position, the surfer marker. When it gets within visual range he can then shut the power off by pressing the on/off button 18, then catch the board and remount.

Figure 41:
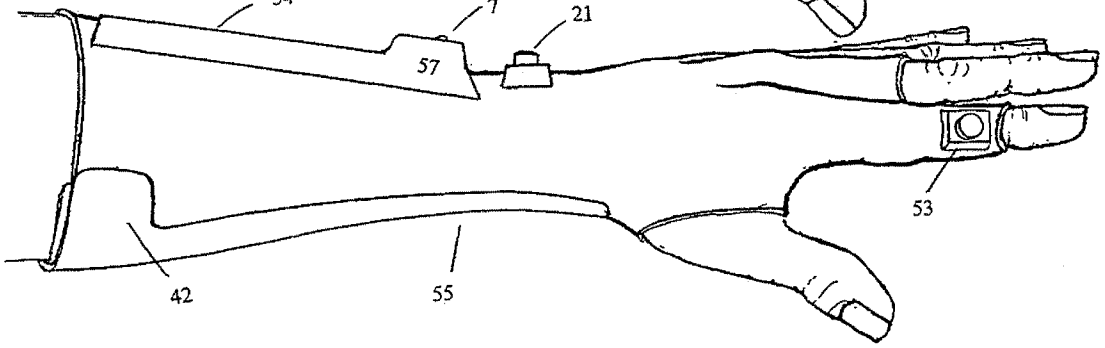
FIG. 41 shows a side view of the surfboard recovery glove 55 shown in FIG. 40.

FIG. 41 shows a side view of the recovery glove 55 shown in FIG. 40. It shows the top of the wrist mounted case 57 that contains a wireless transmitter, a GPS receiver and tracking screen 54, plus a rack that holds four AAA batteries generating six volts of electricity. The case 57 has a removable panel to access the batteries that is waterproofed by two screws and a gasket (not shown). Or, there could be a rechargeable battery pack with a charger plug allowing the battery pack to stay in the case 57 and be charged like a cell phone for example. The GPS receiver gets a satellite signal that produces an aerial view of the surf spot and pinpoints the surfer's exact location on that map. The transmitter 7 sends signals to the surfboard's 3 receiving antenna 6 then to the circuit controller 16, then out to the rudder servo 43 with commands to steer back to the surfer wearing the recovery glove 55. The commands are possible because of a known "dead-stick" technology which is somewhat similar to frequency hopping but more like signal bouncing and measuring. The dead-stick circuitry built into the control box 62 inside the surfboard 3 traces the signal coming from the surfer and glove 55 using its origin as a homing beacon to steer a course back to the surfer. This homing beacon also allows the GPS screen 54 to indicate where the surfboard 3 is located by bouncing signals back and forth. The on/off button 18 on the right hand can control the motor without the surfer on it by overriding the wipeout sensor 65 as long as the recovery button 21 is pressed on. Manual control of the motor 1 allows the surfer to first determine if the board 3 is on the beach or caught inside a set of breaking waves, headed for the rocks. He can shut the motor 1 off therefore retracting the drive 101 and closing the glide doors 103, 106 to minimize damage. Or, if he sees that the coast is clear in between waves he can turn on the power and turn the surfboard towards him. This board return technology is optional, expensive and not necessary for most surfing conditions. But it is possible and can be an asset when surfing giant waves where a board leash is not desirable.

Figure 42:
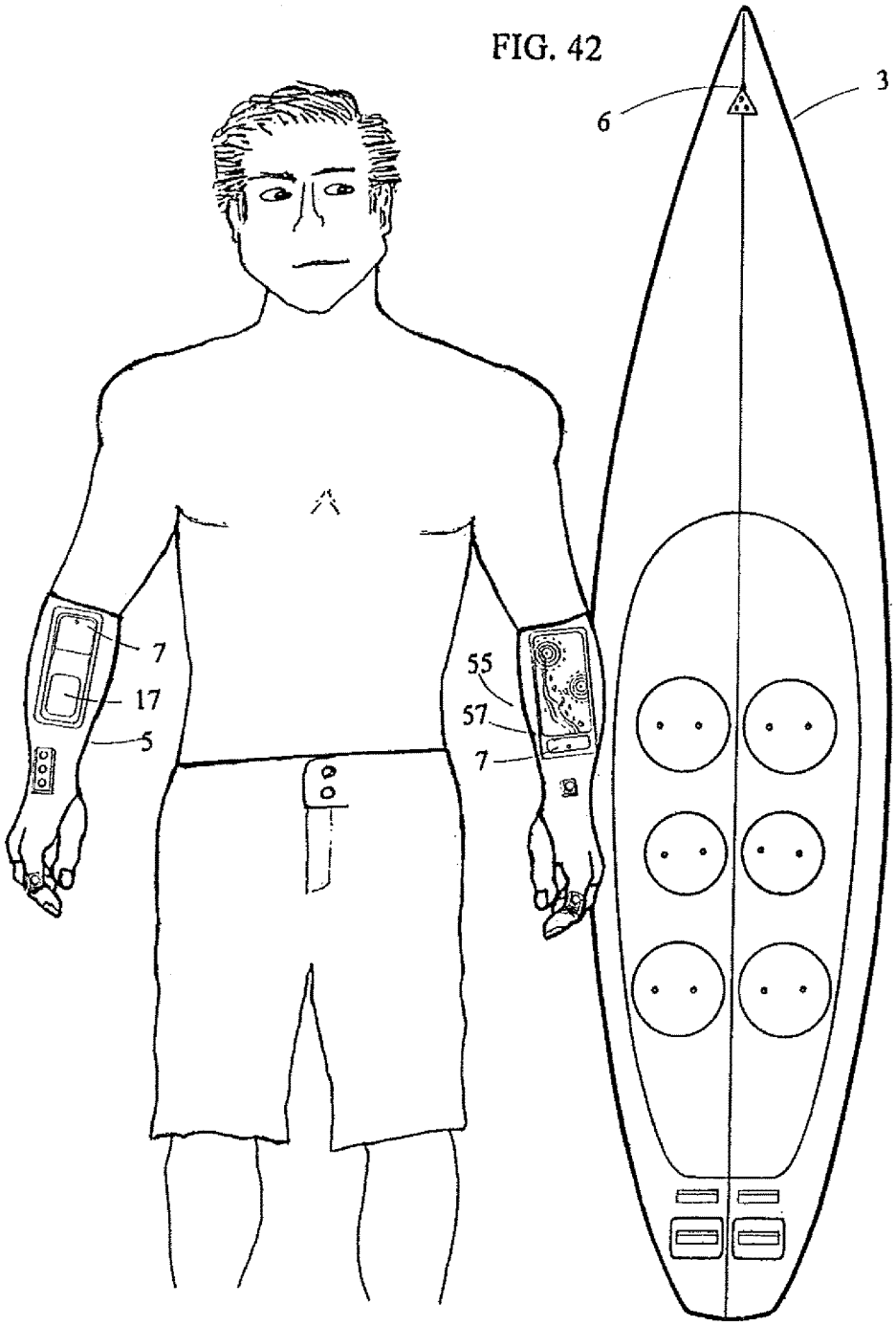
FIG. 42 shows a front view of the complete modern wireless motorized surfer wearing the control glove 5 and the recovery glove 55. Just behind him is the modern motorized jet propelled surfboard 3.

FIG. 42 shows a front view of the complete wireless motorized surfer and a top view of the wireless motorized surfboard 3. It shows the surfer wearing the wireless control glove 5 on his right hand and arm. The wireless transmitter and battery case 17 is seen on his forearm. The transmitter antenna 7 is shown at one end of the case 17. The transmitter antenna 7 sends the signal to the receiver antenna 6 located at the nose of the surfboard 3. The wireless moto surfer is also seen wearing a board recovery glove 55 on the left hand and arm. The GPS receiver, wireless transmitter and battery case 57 is seen on the left forearm. The case 57 contains the GPS receiving antenna (not shown). However, a wireless transmitting antenna 7 is shown at one end of the case 57. The transmitting antenna 7 sends signals to the receiving antenna 6 located at the nose of the surfboard 3. The control glove 5 and the board recovery glove 55 are two embodiments of two control means out of seven control means outlined in this application of the present invention allowing individual preference to determine which control means suits the user.

Figure 43:
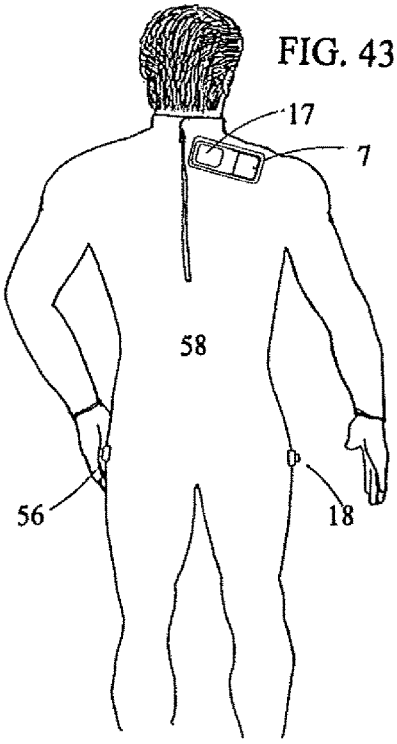
FIG. 43 shows a back view of one embodiment of a hip control wetsuit 58 with two clicker buttons 6, 18 and a back mounted transmitter 7 battery pack 17.

FIG. 43 shows one embodiment of another wireless control means to operate a motorized surfboard. This one is a hip activated wetsuit 58. It has two slightly oversized clicker buttons 56 and 18 located just aft of center on both hips. This location is less likely to be bumped accidently by the surfboard 3 when the surfer is in the prone or standing position. This hip location also makes it easy to access from a prone, crouched or full standing position. The large size and protruding shape of the clicker buttons 18, 56 is desirable to make them easy to locate in a hurry. The on/off button 18 is seen on the surfer's right hip. The two-speed button 56 is seen on the surfer's left hip. The transmitter and battery case 17 is seen mounted on the surfer's upper back which is another location that is unlikely to be bumped accidentally. Wires connecting the two buttons 18, 56 to the transmitter case 17 are sewn and glued into the wetsuit 58. Another advantage to mounting the transmitter case 17 up high on the back shoulder is that the antenna 7 is at a heightened vantage point for wireless reception.

Figure 44:
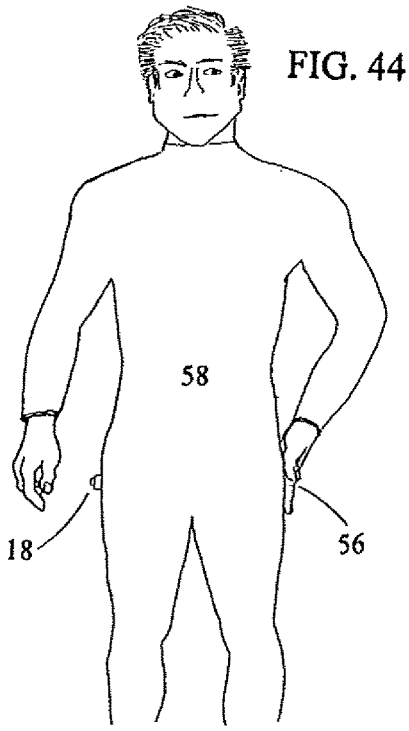
FIG. 44 shows a front view of the same hip control wetsuit 58 shown in FIG. 43.

FIG. 44 shows a front view of the wireless hip control wetsuit 58 shown in FIG. 43. It shows the surfer pressing the two-speed clicker button 56 on his left hip.

Figure 45:
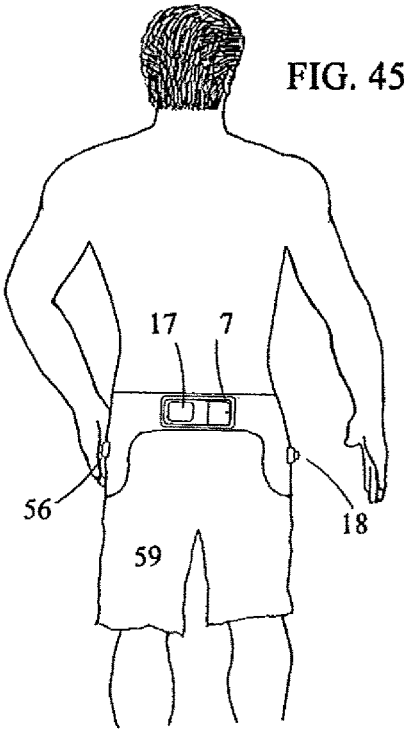
FIG. 45 shows a back view of one embodiment of a pair of hip control board shorts 59 with two clicker buttons 56, 18 and a back mounted transmitter 7 and battery pack 17.

FIG. 45 shows one embodiment of another wireless control means to operate a motorized surfboard. This one is a pair of hip controlled board shorts 59. The clicker buttons 56, 18 are shown in the same advantageous positions as on the hip control wetsuit 58 shown in FIGS. 43 and 44. The transmitter case 17, however, is mounted at the belt line on the backside of the board shorts 59 again to avoid unwanted accidental bumping. The buttons 18, 86 and the case 17 should be preferably mounted on a thickened, more rigid background that could be made out of foam, canvas, or wetsuit material. This background could be sewn, glued or somehow integrated into the upper part of the board shorts 59 and provide a more solid platform to support the components and push the buttons 18, 56 against. The transmitter antenna 7 is seen on one end of the case 17.

Figure 46:
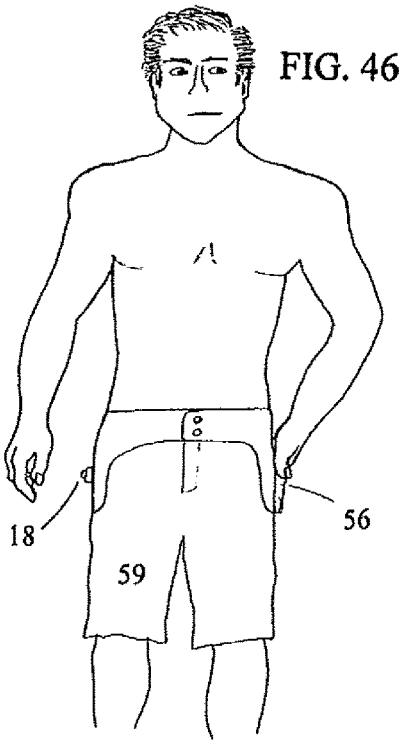
FIG. 46 shows a front view of the same wireless hip control boardshorts 59 shown in FIG. 45.

FIG. 46 shows a front view of the hip control board shorts 59 shown in FIG. 45. It shows how the component 18, 56, 17 background can integrate nicely into the upper portion of the board shorts. Wires connecting the buttons 18, 56 to the case 17 are glued in between layers of the background material. (not shown). The surfer's left hand is seen pressing the two-sided clicker button 56 against the board shorts 59 background at the hip.

Figure 47:
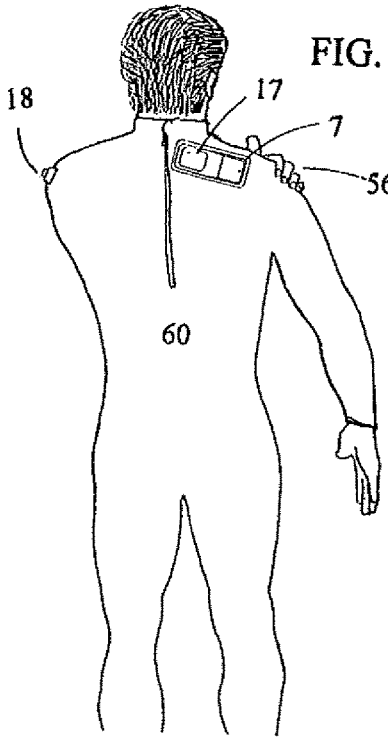
FIG. 47 shows a back view of one embodiment of a wireless shoulder control wetsuit 60 with two clicker buttons 18, 56 and a back mounted transmitter 7 and battery pack 17.

FIG. 47 shows one embodiment of another wireless control means to operate a motorized surfboard. This one is a back view of a shoulder control wetsuit 60. The clicker buttons 18, 56 are shown up high on the surfer's shoulders. This is another advantageous place to mount the clicker buttons 18, 56 by being out of the way when prone paddling or in the standing position. The other advantage is they are accessible in the prone, crouched or standing position by the opposite hand. Wires connecting the buttons 18, 56 to the back shoulder mounted transmitter case 17 are integrated into the wetsuit material. The transmitter antenna 7 is seen on the high back left shoulder.

Figure 48:
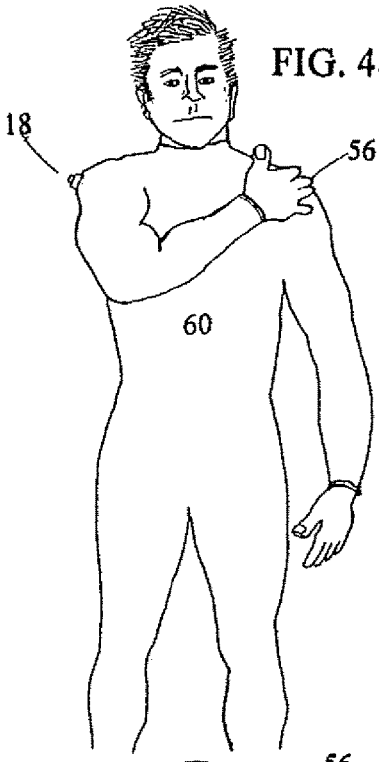
FIG. 48 shows a front view of the same wireless shoulder control wetsuit 60 shown in FIG. 47.

FIG. 48 shows a front view of the shoulder control wetsuit 60 shown in FIG. 47. It shows the surfer's right hand reaching over to press the two speed clicker button 56 on the left shoulder.

Figure 49:
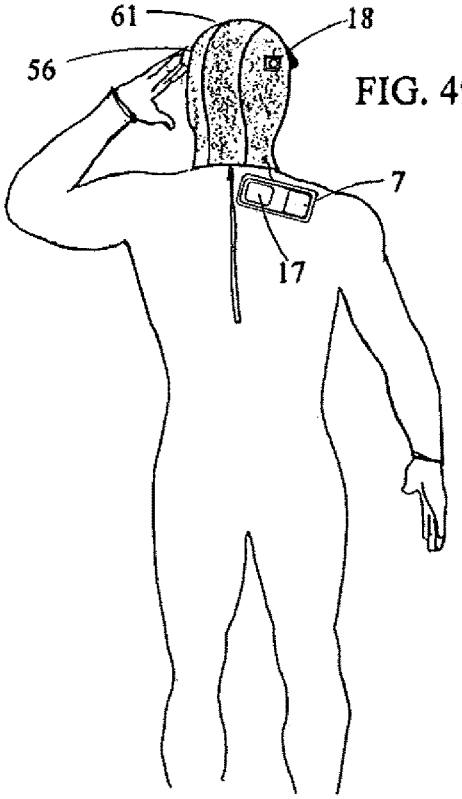
FIG. 49 shows a back view of one embodiment of a wetsuit helmet control means 61 with two clicker buttons 18, 56 and a back mounted transmitter 7 and battery pack 17 with a quick dis-connect wire.

FIG. 49 shows a back view of one embodiment of a wetsuit helmet head control 61 means to operate a wireless motorized surfboard. The clicker buttons 18, 56 are shown mounted just above the ears on either side of the wetsuit helmet 61. This provides an out of the way, easily accessible position for the clicker control buttons 18, 56. A disconnectable wire must travel from the wetsuit helmet 61 mounted buttons 18, 56 out to the transmitter case 17 to enable the surfer to take the helmet 61 on and off.

Figure 50:
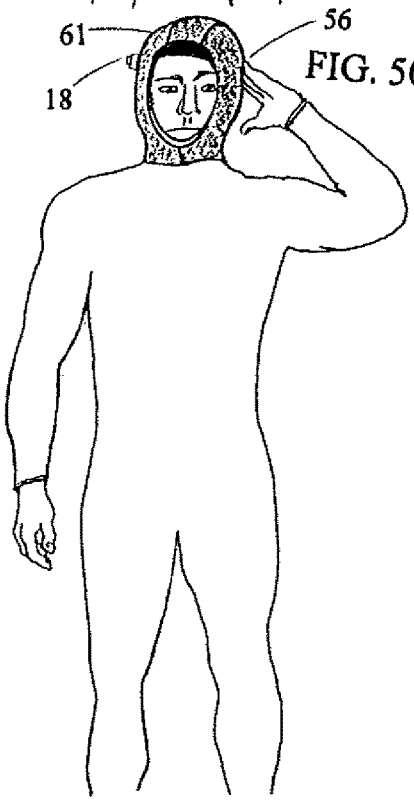
FIG. 50 shows a front view of the same wetsuit control helmet shown in FIG. 49.

FIG. 50 shows a front view of the wetsuit control helmet shown in FIG. 49. The surfer's left hand is seen pressing the two-sided clicker button 56 on the side of his head.

What is claimed:

1. A surfboard having a body with top and bottom surfaces, wherein the body of the surfboard is configured to support a surfer lying in a prone position or standing on the top surface while moving forward, the surfboard defining a longitudinal axis and having a nose at the forward part of the surfboard and a tail at the aft part, also having a single stringer, and with foam and fiberglass construction and with multiple fins, the surfboard is configured to be electric powered and is equipped with at least one brushless motor that is operatively connected to at least one jet drive unit that is contained within the body of the surfboard and is configured to take in water through an intake opening of a jet tube in the bottom of the surfboard and exit through a nozzle at the tail to power the surfboard forward, and allowing a surfer to field and catch waves without paddling, wherein as soon as the wave is moving the surfboard forward, the surfer can close an intake door by pushing a button that enacts a power off sequence provided in a radio control circuit board contained within the body of the surfboard, and configured to receive throttle commands as well as servo and or linear actuator commands to close the intake door, wherein said intake door is configured to close the jet tube intake opening with a substantially seamless fit across the surfboard's bottom surface, thus allowing the surfboard's bottom to form a planing surface without the intake opening causing drag and disrupting water flow, therefore enabling the surfboard to glide freely and the surfer to ride on the wave's power only, the intake opening provides a volume of water to enter the jet tube that leads into an impeller that forces the water out of the jet nozzle allowing a compressed, formed, high pressure stream of water out the tail of the surfboard, said intake door moved by said linear actuator on side tracks and rollers into the closed position;

an intake door seal is provided with three seal gaskets that provide leak free pump suction when opened and a waterproof drive cabin when both open and closed;

an intake door program is configured to open and close at the same time that the motor turns on and shuts off, and this is actuated by a microcircuit controller that is contained in a control box including a throttle control and an R/C receiver, wherein said receiver has an antenna that receives signals from one end of a triangle-shaped wafer that is flush fit at the nose of the surfboard and which can also double as an LED battery level gauge;

the surfboard top surface including crowned deck which provides at least a four inch board thickness at a prone and standing area between two and a half inch thick rails, which allows space for components inside the surfboard and extra flotation without sacrificing thin rail sensitivity and turning performance;

said motor and a battery arrangement contained within a motor battery drive case providing a mass centralization of weight which places the weight bias between the surfer's feet just aft of a widest part of the surfboard, wherein said motor battery drive case has said motor placed in a first dry cabin, said battery comprises at least two battery packs and a control box in a second dry cabin, and a jet tube and impeller unit in said waterproof dry cabin with the intake door and the actuator, at least one manual control comprises an elongated clicker button that is placed in a hand landing area on the surfboard's deck that the surfer uses to push up with his arms to go from a prone to a standing position that at the same time is able to shut off the motor and close the intake door for wave riding;

a hand control glove is provided that has a three speed button set and a thumb to mid forefinger actuated on/off clicker button wherein this glove has a one piece construction that holds the control buttons and components on top of the hand to prevent accidental bumping;

a pair of hip control board shorts or hip control wetsuit is provided that has an on/off clicker button on one hip and a two speed clicker button on the other hip wherein the hip button placement is out of the way from unwanted bumping and allows quick access;

a shoulder control wetsuit is provided that gives the surfer the option to pat the shoulders instead of the hip and also provides out of the way quick access;

a wetsuit helmet control is provided that further extends the control options to pat the side of the head to click on/off or two speeds on the other;

a hand controlled recovery glove is also provided that has a GPS map screen and that sends out a homing beacon that has the ability to track and return a lost surfboard after a wipe out, wherein all buttons and controls placed on top of the hand and out of the way from unwanted bumping, and is configured to work by optional circuitry built into the control box that steers a rudder that doubles as a center fin that moves by way of a servo on an overhead stand that connects to a rudder post, wherein the turnable center fin can also be configured to assist steering under power with a rider on board, wherein an onboard sensor located in the second drive cabin turns the motor off, and closes the intake doors once the rider leaves the deck of the surfboard by a wipeout while surfing.

* * * * *